US007515871B2

(12) United States Patent
Mae et al.

(10) Patent No.: US 7,515,871 B2
(45) Date of Patent: Apr. 7, 2009

(54) IMAGE FORMING SYSTEM

(75) Inventors: Hideo Mae, Okazaki (JP); Kazuo Okunishi, Nukata-gun (JP); Tatsutoshi Yamada, Toyokawa (JP); Atsushi Kawai, Toyokawa (JP); Yoshihiko Yoshizaki, Hoi-gun (JP); Kou Yamada, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 274 days.

(21) Appl. No.: 11/181,922

(22) Filed: Jul. 15, 2005

(65) Prior Publication Data

US 2006/0204253 A1 Sep. 14, 2006

(30) Foreign Application Priority Data

Mar. 8, 2005 (JP) ..... 2005-064505

(51) Int. Cl.
*G03G 15/00* (2006.01)
*G03G 21/00* (2006.01)

(52) U.S. Cl. ..... 399/407; 399/16; 399/21

(58) Field of Classification Search ..... 399/1–407
See application file for complete search history.

(56) References Cited

U.S. PATENT DOCUMENTS 4,864,365 A * 9/1989 Ito ..... 399/28
6,542,715 B2 * 4/2003 Miyamoto et al. ..... 399/405
6,594,545 B1 * 7/2003 Kakigi ..... 700/223
6,728,510 B1 * 4/2004 Markovitz et al. ..... 399/403
6,763,202 B2 * 7/2004 Maeda ..... 399/53

FOREIGN PATENT DOCUMENTS

| | | | |
|---|---|---|---|
| JP | 10-316298 | | 12/1998 |
| JP | 410316298 | A * | 12/1998 |
| JP | 11-157725 | | 6/1999 |
| JP | 2003-348051 | | 12/2002 |
| JP | 2003-081494 | | 3/2003 |
| JP | 2003-098765 | | 4/2003 |
| JP | 02004205600 | A * | 7/2004 |

OTHER PUBLICATIONS

Japanese Official Notification of Reasons for Refusal dated Feb. 20, 2007 (with English Translation).

* cited by examiner

*Primary Examiner*—Daniel J Colilla
*Assistant Examiner*—Allister Primo
(74) *Attorney, Agent, or Firm*—Buchanan Ingersoll & Rooney PC

(57) ABSTRACT

An image forming system having an image forming apparatus and a post-processing apparatus having a sorting function, a stapling function, etc. The post-processing apparatus is movable between a first position to receive long papers and a second position to receive non-long papers. When the post-processing apparatus is set in the second position, a paper inlet port of the post-processing apparatus faces a paper ejection port of the image forming apparatus.

22 Claims, 19 Drawing Sheets

IMAGE FORMING SYSTEM

This application is based on a Japanese application No. 2005-64505 filed on Mar. 8, 2005, the content of which is incorporated by reference.

BACKGROUND OF THE INVENTION

1. Field of the Invention

The present invention relates to an image forming system, and more particularly to an image forming system comprising an image forming apparatus and a post-processing apparatus having a function as a sorter, a stapler or the like.

2. Description of Related Art

Image forming apparatuses are generally structured to print images on papers of regular sizes, such as A4, A3, etc. However, there are cases in which printing on longer papers is required.

Conventionally, image forming apparatuses provided with post-processing apparatuses having functions as sorters, staplers or the like have a problem that a paper jam is likely to occur when a long paper is fed therein, and therefore such image forming apparatuses are constructed not to perform printing on long papers. This prevents users who desire printing on long papers from attaching post-processing apparatuses to their image forming apparatuses.

On contrary, when printing on long papers is to be performed by use of an image forming apparatus provided with a post-processing apparatus, the user has to take measures, for example, request an engineer having special knowledge and skill to detach the post-processing apparatus from the image forming apparatus. Thus, conventional image forming systems have been far away from meeting both of the demands for various functions by use of a post-processing apparatus and for printing on long papers by use of an image forming apparatus.

In order to comply with the demand for printing on long papers, some types of image forming apparatuses have been introduced into the market. Also, Japanese Patent Laid-Open Publication Nos. 2003-98765, 2003-81494, 2002-348051 and 10-316298 have raised suggestions about printing and/or post-processing on long papers.

However, in order to enable printing on long papers in an image forming apparatus provided with a post-processing apparatus, the post-processing apparatus shall be complicatedly structured, and in view of cost and skill, it is almost impossible to actually construct the post-processing apparatus. The prior arts premise that long papers are to be aligned, stapled, punched, folded and/or sorted, and the structure for the purpose is complicate. Further, combining the complicate structure with a mechanism for feeding the long papers is technically more difficult, and in view of cost and size, it is practically impossible.

For example, a task for feeding a long paper to a post-processing apparatus is providing a secure guide to prevent askew feeding of papers. The post-processing apparatus incorporates, for example, a mechanism for stapling papers, and further providing the post-processing apparatus with a large-size guide for preventing stacking of askew-fed long papers results in an increase in size and an increase in cost.

SUMMARY OF THE INVENTION

An object of the present invention is to provide an image forming system provided with a post-processing apparatus for processing regular-size papers and non-long papers, the image forming system being capable of printing on long papers impossible to be processed by the post-processing apparatus.

In order to attain the object, an image forming system according to the present invention comprises an image forming apparatus, a post-processing apparatus and a control section for controlling the image forming apparatus and the post-processing apparatus, and the post-processing apparatus is movable between a first position to receive a long paper from the image forming apparatus and a second position to receive a non-long paper from the image forming apparatus.

Here, non-long papers mean papers of sizes which are expected to be printed in an ordinary image forming apparatus, in other words, papers of sizes specified by ISO and/or JIS based on the maximum size in the direction perpendicular to the paper feeding direction and papers of regular sizes derived from the specified sizes. Long papers mean papers with larger lengths in the paper feeding direction than the non-long papers.

In the image forming system according to the present invention, when the post-processing apparatus is set in the first position, printing on long papers and ejection thereof are possible. When the post-processing apparatus is set in the second position, printing on non-long papers and post-processing (sorting, stapling, etc) thereof are possible.

According to the present invention, the image forming system has at least one of a first detector for detecting the post-processing apparatus set in the first position and a second detector for detecting the post-processing apparatus set in the second position. The post-processing apparatus may be moved between the first position and the second position manually, or alternatively automatically by use of a motor or a gear.

When the post-processing apparatus is set in the first position, the post-processing apparatus is apart from the image forming apparatus, and in order to remove a jammed paper, the post-processing apparatus must be set in this position. Accordingly, when the post-processing apparatus is moved to the first position after detection of a paper jam, the control section judges that the jammed paper is being removed. When the post-processing apparatus is moved to the second position thereafter, the control section judges that the removal of the jammed paper has been completed.

Also, in the image forming system according to the present invention, preferably, when the post-processing apparatus is set in the first position, an upper surface of a cover of the post-processing apparatus serves as a guide for a long paper ejected from the image forming apparatus. This eliminates the necessity of separately providing a long paper guide member.

Additionally, it is preferred that when the post-processing apparatus is set in the first position, the upper surface of the cover is located below the paper ejection port of the image forming apparatus and that when the post-processing apparatus is set in the second position, the paper inlet port of the post-processing apparatus substantially faces the paper ejection port of the image forming apparatus. In order to implement this, the post-processing apparatus merely needs to be moved horizontally, and in this structure, the upper surface of the post-processing apparatus serves as a guide for long papers.

The control section has different criteria for judgement depending on whether the post-processing apparatus is set in the first position or in the second position or whether a print mode of the image forming apparatus is a long paper mode in which a long paper is used or a non-long paper mode in which a non-long paper is used. Specifically, in the long paper mode, at least unless the post-processing apparatus is in the first position, the control section judges that printing is impossible. In the non-long paper mode, at least unless the post-processing apparatus is in the second position, the control section judges that printing is impossible. Thus, unnecessary printing is avoided.

Further, when the control section judges that printing is impossible, preferably, the control section prohibits the image forming apparatus from printing and raises a warning to change the position of the post-processing apparatus or to change the print mode.

Also, if the post-processing apparatus has an automatic moving mechanism, in the long paper mode, when the post-processing apparatus is not in the first position, the control section preferably controls the moving mechanism to move the post-processing apparatus to the first position. Also, in the non-long paper mode, when the post-processing apparatus is not in the second position, the control section may control the moving mechanism to move the post-processing apparatus to the second position.

Additionally, when the post-processing apparatus is not in the first position, the control section prohibits selection of the long paper mode. Also, when the post-processing apparatus is not in the second position, the control section prohibits selection of the non-long paper mode. Thereby, unnecessary printing is avoided.

The image forming apparatus may be connectable selectively to different types of post-processing apparatuses. In this case, the control section judges the type of the post-processing apparatus connected to the image forming apparatus and preferably changes the control procedure in the long paper mode depending on the type of the post-processing apparatus. For example, if the post-processing apparatus is of a long paper complying type, the control section allows printing on long papers, and if the post-processing apparatus does not comply with long papers, the control section prohibits printing on long papers.

Further, when the post-processing apparatus is set in the first position, the control section may prohibit movement of the post-processing apparatus.

BRIEF DESCRIPTION OF THE DRAWINGS

This and other objects and features of the present invention will be apparent from the following description with reference to the accompanying drawings, in which:

FIG. 5*c* is an illustration when the post-processing apparatus is set in the first position;

DETAILED DESCRIPTION OF THE PREFERRED EMBODIMENTS

An embodiment of an image forming system according to the present invention is described with reference to the accompanying drawings.

General Structure of Image Forming System; See FIGS. 1-6

Figure 1:
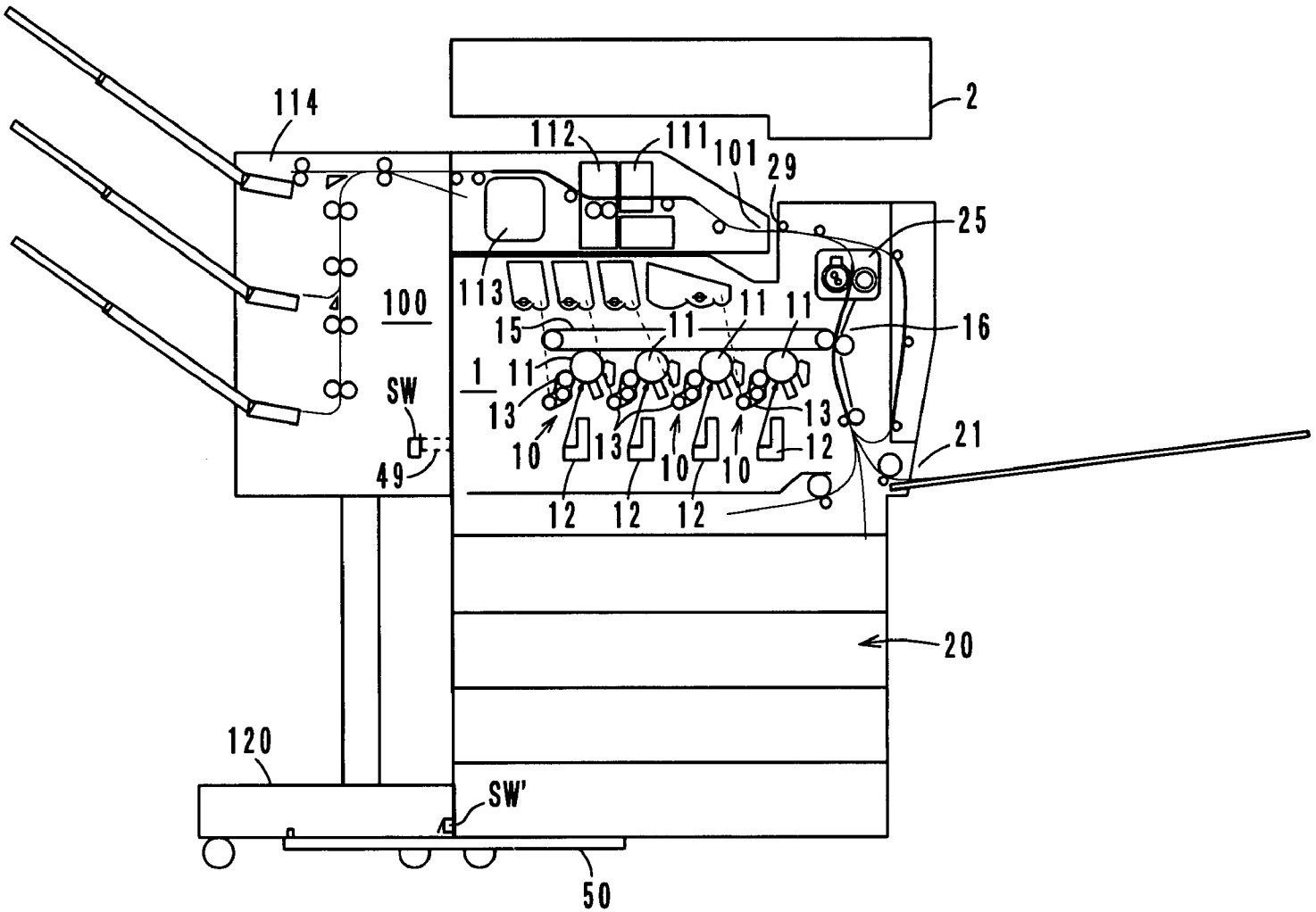
FIG. 1 is a schematic view of an image forming system according to the present invention, showing a state wherein a post-processing apparatus is set in a second position.
Figure 2:
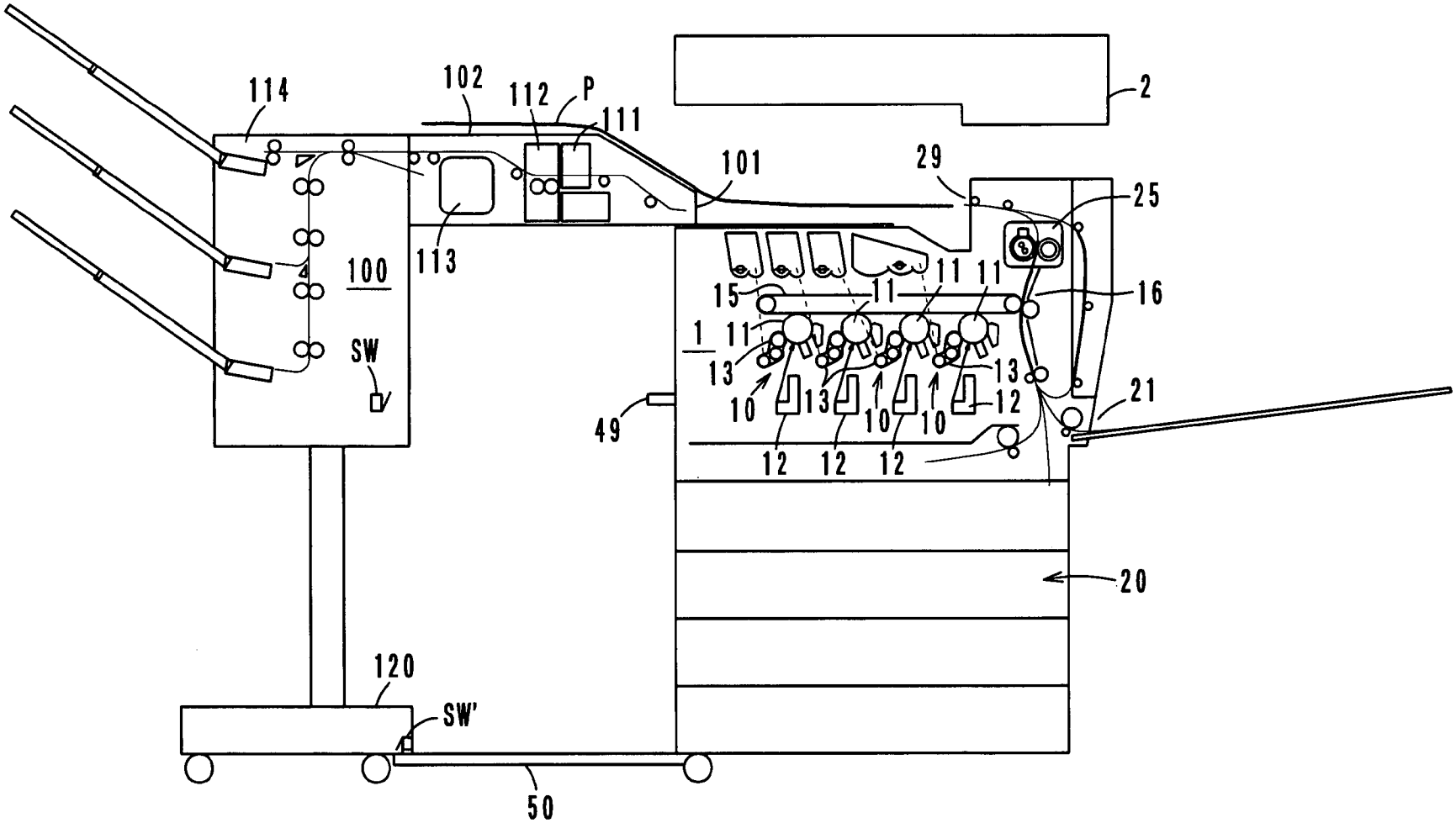
FIG. 2 shows a state of the image forming system shown by FIG. 1 wherein the post-processing apparatus is set in a first position.

An image forming system shown by FIGS. 1 and 2 comprises an image forming apparatus 1 and a post-processing apparatus 100. FIG. 1 shows a state in which the post-processing apparatus 100 is set in a second position to receive non-long papers from the image forming apparatus 1. FIG. 2 shows a state in which the post-processing apparatus 100 is set in a first position to receive long papers from the image forming apparatus.

Here, non-long papers mean papers of sizes which are originally expected to be subjected to printing in the image forming apparatus 1, and long papers mean papers of longer sizes with respect to the paper feeding direction.

The post-processing apparatus 100 is movable horizontally along rails 50 from and to the image forming apparatus 1 so that a user can move the post-processing apparatus 100 between the first position and the second position by hand. A stopper (not shown) is provided for the rails 50 so as to prevent the post-processing apparatus 100 from being moved too far from the image forming apparatus 1 beyond the first position.

The post-processing apparatus 100 has a position detection switch SW. When the post-processing apparatus 100 is set in the second position (see FIG. 1), the switch SW is turned on by a protrusion 49 of the image forming apparatus 1, and when the post-processing apparatus 100 is moved to the first position (see FIG. 2), the switch SW is turned off. In this way, the position of the post-processing apparatus 100 can be detected.

Instead of the switch SW, a switch SW' may be provided for a base 120 of the post-processing apparatus 100. The switch SW' is turned on and off depending on whether the base 120 is in or out of contact with the image forming apparatus 1. Alternatively, a switch SW1 for detecting the post-processing apparatus 100 set in the first position and a switch SW2 for detecting the post-processing apparatus 100 set in the second position may be provided. The control procedure described later is for the case wherein the switches SW1 and SW2 are provided.

Now, the structure of the image forming apparatus 1 and the structure of the post-processing apparatus 100 are briefly described. The image forming apparatus 1 is an electrophotographic color printer which is structured to combine four color images by a tandem method, and has a scanner 2 for reading an image of a document.

The scanner 2 is of a conventional type which reads an image of a document placed on a document glass (not shown) by use of an image sensor, such as CCD elements. The image of the document is resolved into three-primary-color components, namely, R (red), G (green) and B (blue) components, which are then converted into electric signals (data). Further, the data are converted into signals (data) for developing colors, namely, Y (yellow), M (magenta), C (cyan) and K (black).

As to the major items of the image forming apparatus 1, print heads 10 for forming YMCK images respectively are arrayed immediately under an intermediate transfer belt 15. Each of the print heads 10 comprises a photosensitive drum 11, a laser scanning optical device 12 and developing device 13. In the print heads 10, the laser scanning optical devices 12 receive the YMCK image data respectively and form electrostatic latent images on the photosensitive drums 11 respectively in accordance with the YMCK image data, and the developing devices 13 develop the latent images. This electrophotographic process is well known, and a detailed description thereof is omitted.

Under the main body of the image forming apparatus 1, an automatic feeding section 20 for feeding stacked non-long papers (regular-size papers) one by one and a manual feeding section 21 for feeding long papers are provided. The manual feeding section 21 is capable of feeding non-long papers also.

The intermediate transfer belt 15 receives toner images from the photosensitive drums 11 (primary transfer) while rotating, and thereby, four color images are combined into a full-color image. In the meantime, papers are fed upward one by one from the automatic feeding section 20 or the manual feeding section 21. Each paper receives the full-color toner image from the intermediate transfer belt 15 at a secondary transfer section 16 and thereafter are fed to a fixing unit 25, where the toner image is fixed on the paper by heat. Then, the paper is ejected through a paper ejection port 29.

When the paper is a non-long paper, the paper comes from the ejection port 29 into the post-processing apparatus 100 set in the second position as shown in FIG. 1. As is apparent from FIG. 1, when the post-processing apparatus 100 is in the second position, an inlet port 101 of the post-processing apparatus 100 faces the ejection port 29 of the image forming apparatus 1.

When the paper is a long paper, the paper P is guided from the ejection port 29 onto a cover 102 of the post-processing apparatus 100 set in the first position as shown in FIG. 2.

The post-processing apparatus 100 comprises a puncher unit 111 for punching papers, a folder unit 112 for folding papers, a stapler unit 113 for stapling papers and a sorter unit 114 for sorting/storing papers. The structures and operation of these units are well known, and detailed descriptions thereof are omitted.

Figure 3:
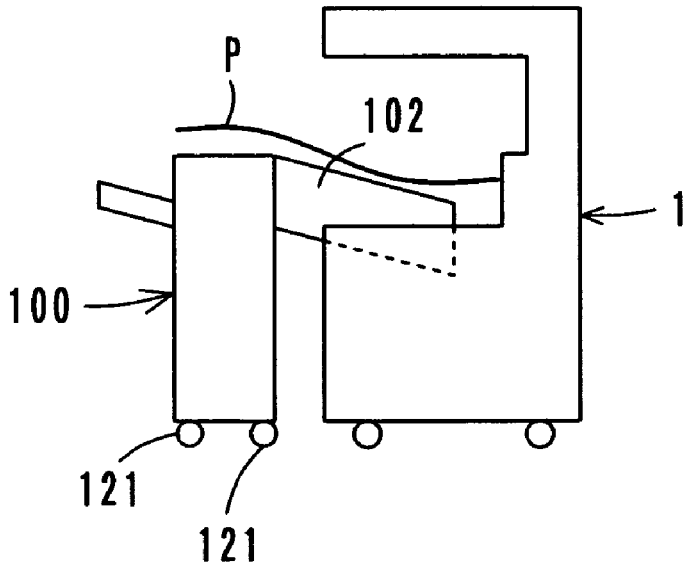
FIG. 3 is an appearance of another image forming system according to the present invention.

FIGS. 3 through 5*c* show other structures for guiding long papers ejected from the image forming apparatus 1. In an image forming system shown by FIG. 3, the post-processing apparatus 100 has wheels 121 and therefore is movable between the first position and the second position as described above, and the upper surface of the cover 102 tilts. FIG. 3 shows a state wherein the post-processing apparatus 100 is set in the first position and a long paper P ejected from the image forming apparatus 1 is supported by the tilting upper surface of the cover 102.

Figure 4:
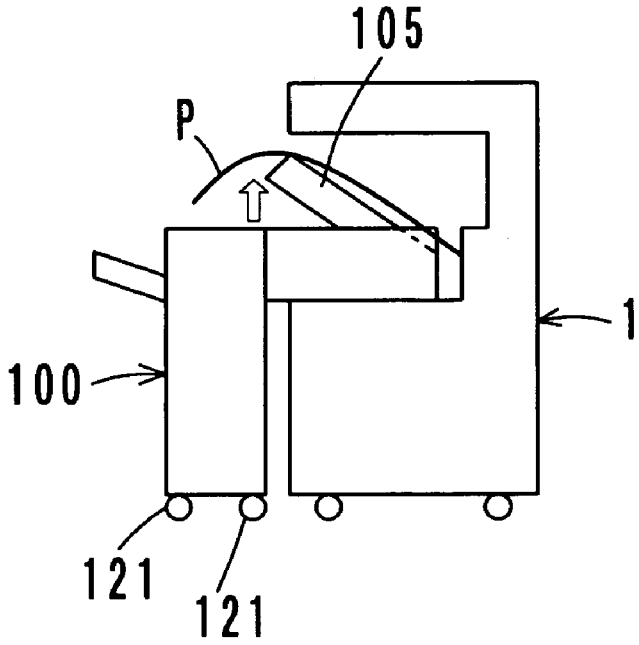
FIG. 4 is an appearance of a further another image forming system according to the present invention.

In an image forming system shown by FIG. 4, the post-processing apparatus 100 has a tilting guide plate 105 on the cover 102. FIG. 4 shows a state wherein the post-processing apparatus 100 is set in the first position and a long paper ejected from the image forming apparatus 1 is supported by the guide plate 105.

Figure 5A:
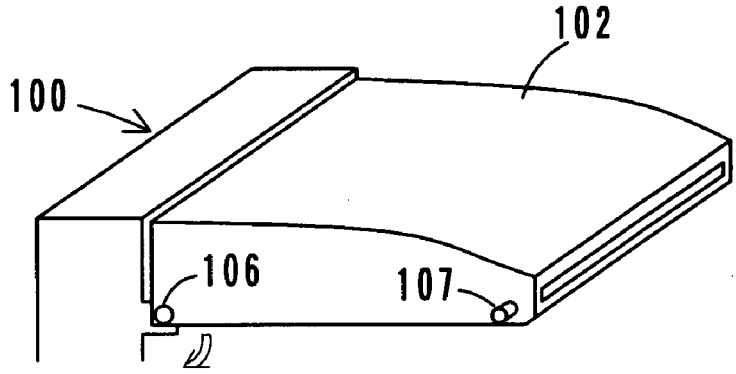
FIGS. 5*a*, 5*b* and 5*c* show a part of the image forming system shown by FIG. 4, FIG. 5*a* being a perspective view of a post-processing apparatus, FIG. 5*b* showing an illustration when the post-processing apparatus is set in the second position.
Figure 5B:
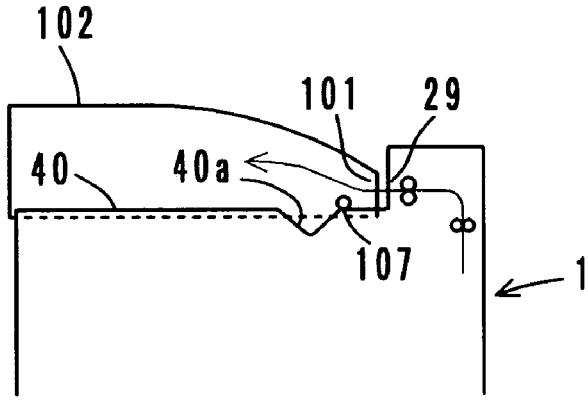
Figure 5C:
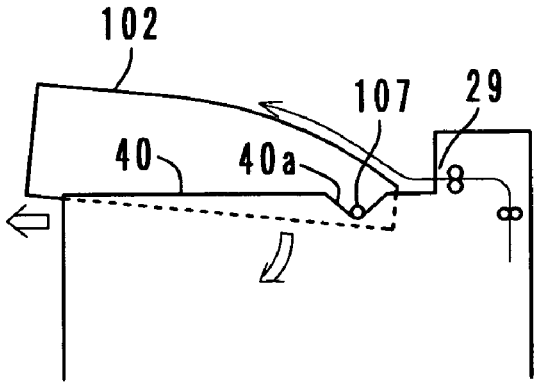

In an image forming system shown by FIG. 5*a*, the cover 102 of the post-processing apparatus 100 is pivoted on a pin 106 (see FIG. 5*a*), and a guide pin 107 fixed on an edge of the cover 102 engages with and slides along a guide rail 40 of the image forming apparatus 1.

When the post-processing apparatus 100 is in the second position (see FIG. 5*b*), the guide pin 107 is above the guide rail 40, and the paper inlet port 101 faces the ejection port 29 of the image forming apparatus 1. Thereby, non-long papers are guided into the post-processing device 100. When the post-processing apparatus 100 is set in the first position (see FIG. 5*c*), the guide pin 107 falls into a groove 40*a* of the guide rail 40, and the edge of the cover 102 falls down. Therefore, the edge of the cover 102 is located under the ejection port 29 of the image forming apparatus 1, and a long paper 29 ejected from the ejection port 29 is guided by the upper surface of the cover 102.

Figure 6:
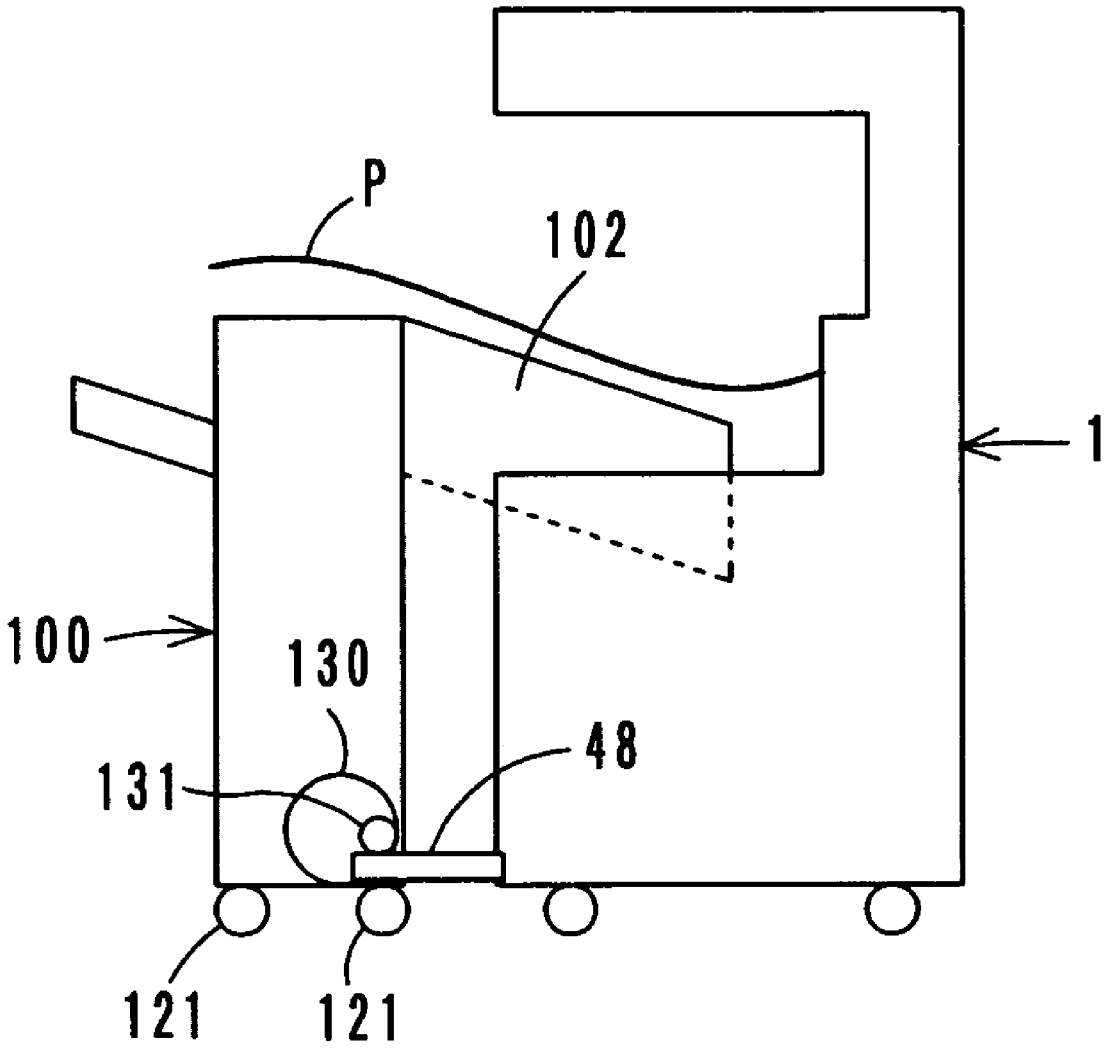
FIG. 6 is an appearance of a further another image forming system according to the present invention.

FIG. 6 shows a mechanism for moving the post-processing apparatus 100 from/to the first and second positions automatically. Because of the wheels 121, the post-processing apparatus 100 is freely movable, and a pinion 131 rotated by a motor 130 engages with a rack 48 connected to the image forming apparatus 1. In this structure, by controlling the direction of rotation of the motor 130, the post-processing apparatus 100 can be moved selectively to the first position or to the second position.

Control Sections; See FIGS. 7 and 8

Next, a control section of the image forming apparatus 1 and a control section of the post-processing apparatus 100 are described.

Figure 7:
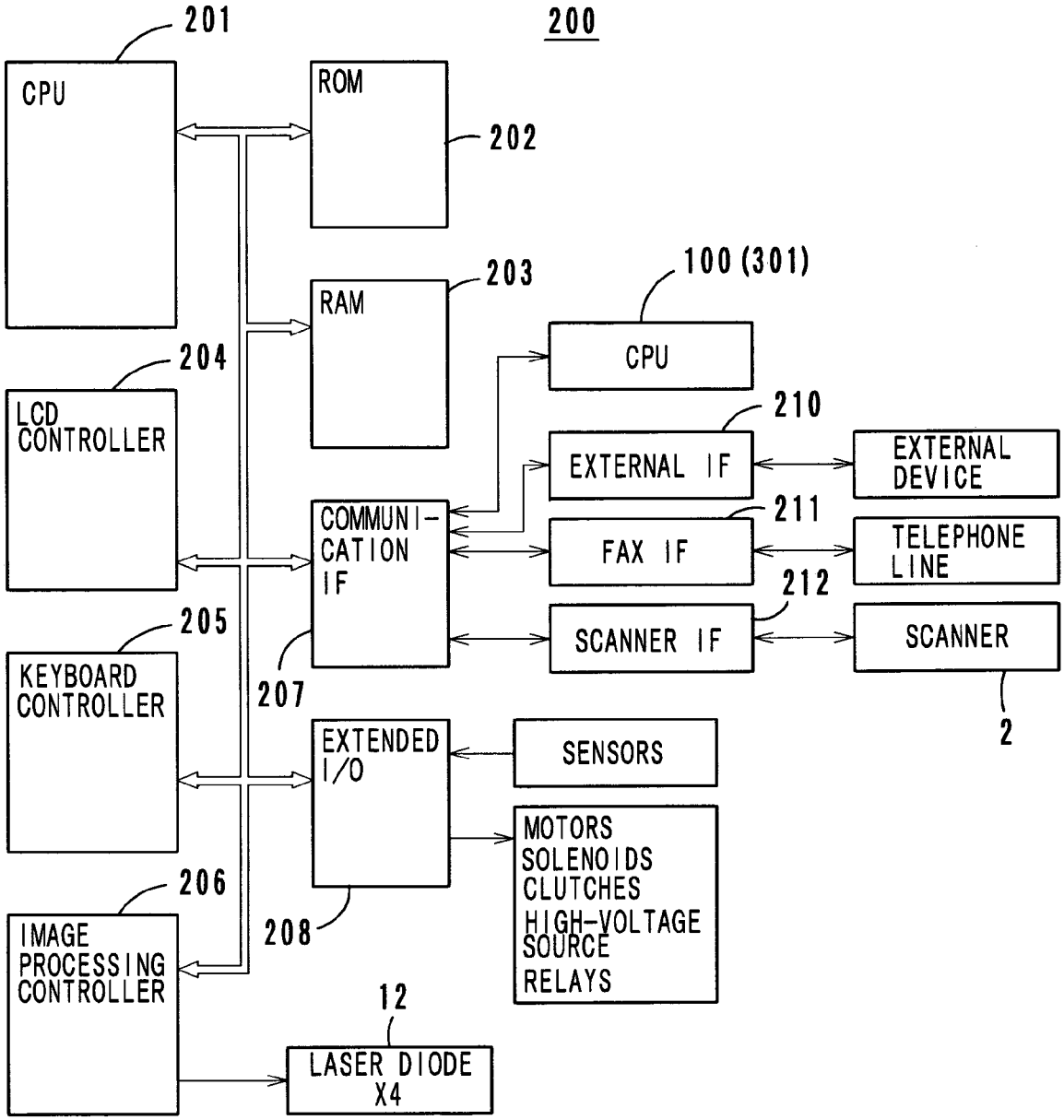
FIG. 7 is a block diagram of a control section of an image forming apparatus.

As FIG. 7 shows, the main element of the control section 200 is a CPU 201. The CPU 201 incorporates a ROM 202 stored with a control program, etc. and a RAM 203 for temporarily storing control parameters, etc., and is connected to an LCD controller 204 for controlling an operation/display panel, which will be described later, a keyboard controller 205, an image processing controller 206, a communication interface 207 and an extended I/O port 208.

The image processing controller 206 controls laser diodes of the laser scanning optical devices 12. The communication interface 207 communicates with a CPU 301 of the post-processing apparatus 100 and further communicates with an external device such as a computer, a telephone line and the scanner 2 via an external interface circuit 210, a fax interface 211 and a scanner interface 212. The extended I/O port 208 receives signals from various sensors and switches provided in the image forming apparatus 1 and sends control signals to various motors, solenoids, clutches, a high-voltage power source, relays, etc.

Figure 8:
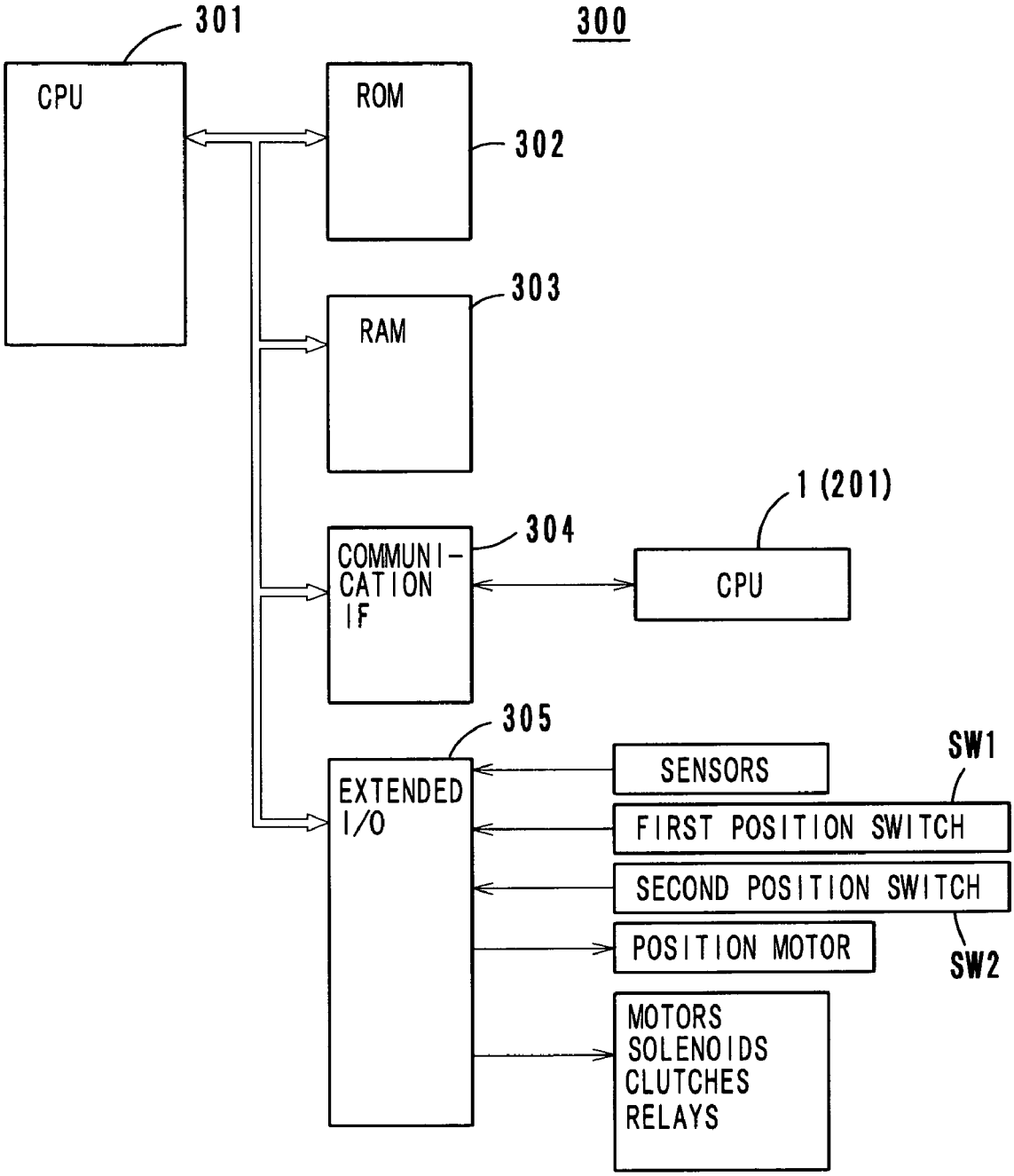
FIG. 8 is a block diagram of a control section of the post-processing apparatus.

As FIG. 8 shows, the main element of a control section 300 of the post-processing apparatus 100 is a CPU 301. The CPU 301 incorporates a ROM 302 stored with a control program and a RAM for temporarily storing control parameters, and is connected to a communication interface 304 and an extended I/O port 305.

The communication interface 304 communicates with the CPU 201 of the image forming apparatus 1. The extended I/O port 305 receives signals from various sensors, the first position switch SW1 and the second position switch SW2 and sends control signals to various motors, solenoids, clutches and relays.

Criteria for Control

Figure 10:
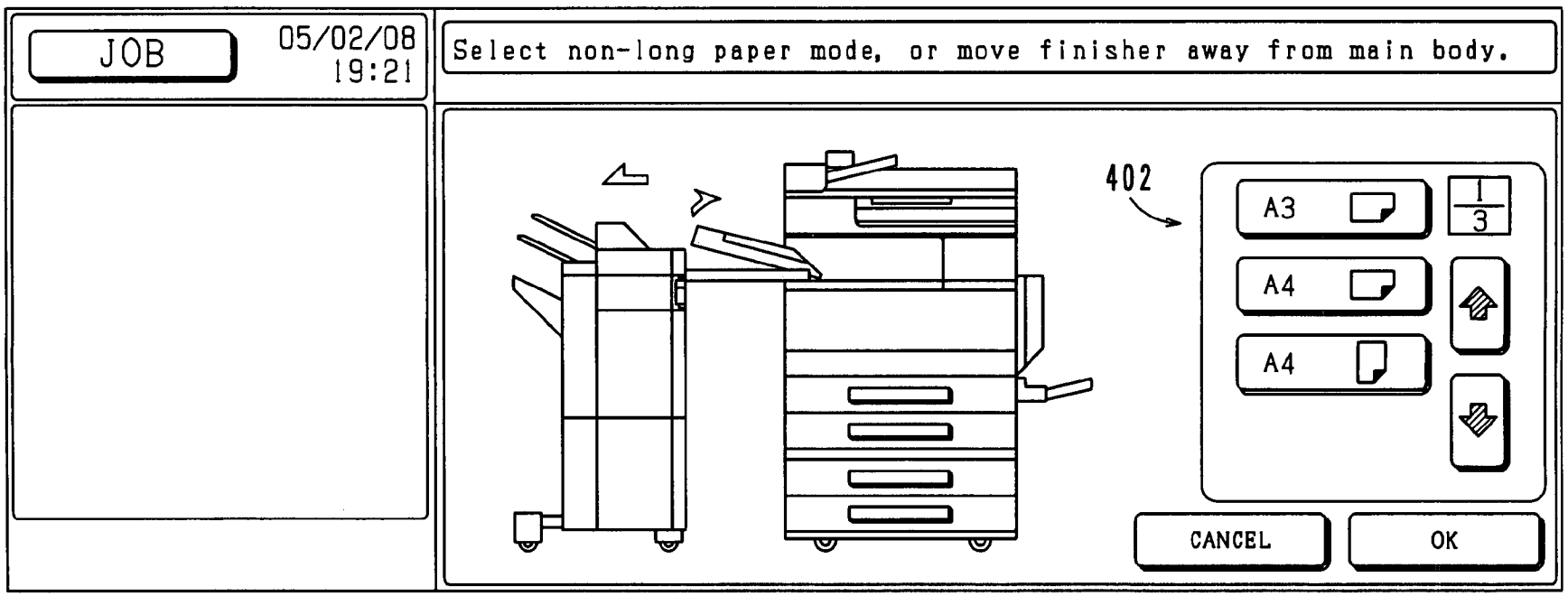
FIG. 10 is a plan view of a display panel, showing an exemplary display when the post-post processing apparatus is set in the first position.

Table 1 shows conditions of the image forming system for control of printing, and more specifically, decision of permission/prohibition of printing from the position of the post-processing apparatus 100 and the selected print mode (long paper printing or non-long paper printing). Table 1 also shows an exemplary control in which a warning is raised when printing is prohibited. As Table 1 shows, permission/prohibition of printing is decided depending on the current position of the post-processing apparatus 100 and the selected print mode, and when a user operates the image forming system, the permitted/prohibited state changes.

when the post-processing apparatus 100 is moved from the first position to the second position, a printing prohibition message is displayed as a warning (see FIG. 10).

Figure 9:
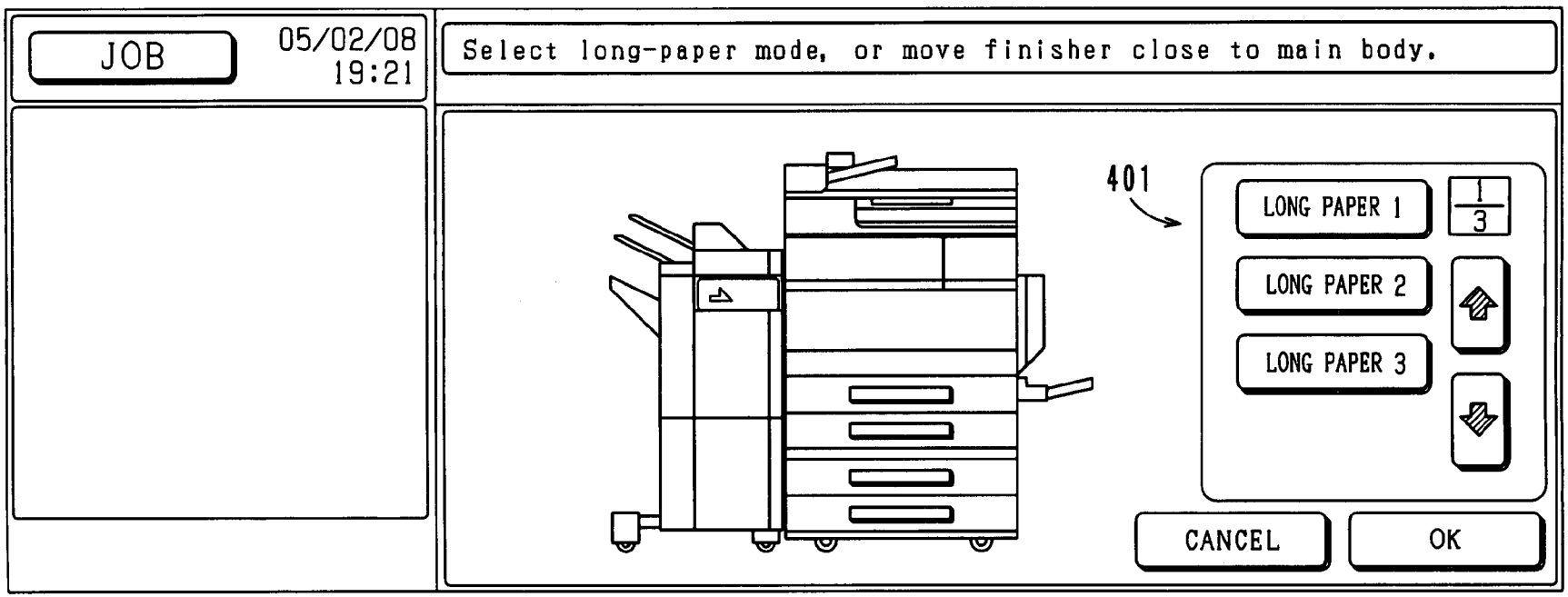
FIG. 9 is a plan view of a display panel, showing an exemplary display when the post-post processing apparatus is set in the second position.

When the post-processing apparatus 100 is in the first position and when the non-long paper mode is selected, a printing prohibition message is displayed as a warning (see FIG. 9). Then, the print mode is changed to the long paper mode, the warning message is deleted from the display panel, and a printing permission message is displayed. Also, when the post-processing apparatus 100 is moved from the first position to the second position, the warning message is deleted from the display panel, and a printing permission message is displayed.

When the post-processing apparatus 100 is in the second position and when the long paper mode is selected, a printing prohibition message is displayed on the display panel as a warning (see FIG. 10). Then, when the print mode is changed to the non-long paper mode, the warning message is deleted from the display panel, and a printing permission message is displayed. Also, when the post-processing apparatus 100 is moved from the second position to the first position, the warning message is deleted from the display panel, and a printing permission message is displayed.

When the post-processing apparatus 100 is in the second position and when the non-long paper mode is selected, a printing permission message is displayed on the display panel. Then, when the print mode is changed to the long paper mode, a printing prohibition message is displayed on the display panel as a warning (see FIG. 10). Also, when the post-processing apparatus 100 is moved from the second position to the first position, a printing prohibition message is displayed on the display panel as a warning (see FIG. 9).

TABLE 1

| Current State | | | Operation | | | |
|---|---|---|---|---|---|---|
| Position of | | | Change of Print Mode | | | |
| Post-Processing | Print | | Long Paper to | Non-Long Paper to | Movement of Post-Processing Apparatus | |
| Apparatus | Mode | Display Panel | Non-Long Paper | Long Paper | First to Second | Second to First |
| First | Long Paper | Printing Permitted | Printing Prohibited Warning (FIG. 9) Displayed | | Printing Prohibited Warning (FIG. 10) Displayed | |
| First | Non-Long Paper | Printing Prohibited Warning (FIG. 9) Displayed | | Warning Deleted Printing Permitted | Warning Deleted Printing Permitted | |
| Second | Long Paper | Printing Prohibited Warning (FIG. 10) Displayed | Warning Deleted Printing Permitted | | | Warning Deleted Printing Permitted |
| Second | Non-Long Paper | Printing Permitted | | Printing Prohibited Warning (FIG. 10) Displayed | | Printing Prohibited Warning (FIG. 9) Displayed |

According to Table 1, when the post-processing apparatus 100 is in the first position and when the long paper mode is selected, a printing permission message is displayed on the display panel. Then, when the print mode is changed to a non-long paper mode, a printing prohibition message is displayed on the display panel as a warning (see FIG. 9). Also, Table 2 below shows an exemplary control for prohibiting the user from selecting print modes other than the permitted print mode depending on the position of the post-processing apparatus 100. The "icon of long paper mode" in Table 2 is denoted by numeral 401 in FIG. 9, and the "icon of non-long paper mode" is denoted by numeral 402 in FIG. 10.

TABLE 2

| Current State | | | Operation | | | |
|---|---|---|---|---|---|---|
| | | | Change of Print Mode | | | |
| Position of Post-Processing Apparatus | Print Mode | Display Panel | Long Paper to Non-Long Paper | Non-Long Paper to Long Paper | Movement of Post-Processing Apparatus: First to Second | Movement of Post-Processing Apparatus: Second to First |
| First | Long Paper | Printing Permitted<br>Icon of Non-Long Paper Mode Not Displayed | Selection Impossible | | Printing Prohibited<br>Warning (FIG. 10) Displayed<br>Icon of Non-Long Paper Mode Displayed | |
| First | Non-Long Paper | Printing Prohibited<br>Warning (FIG. 9) Displayed<br>Icon of Non-Long Paper Mode Not Displayed | | Warning Deleted<br>Printing Permitted | Icon of Long Paper Mode Not Displayed<br>Warning Deleted<br>Printing Permitted | |
| Second | Long Paper | Printing Prohibited<br>Warning (FIG. 10) Displayed<br>Icon of Long Paper Mode Not Displayed | Warning Deleted<br>Printing Permitted | | | Warning Deleted<br>Printing Permitted<br>Printing Prohibited<br>Warning (FIG. 9) Displayed<br>Icon of Long Paper Mode Displayed<br>Icon of Non-Long Paper Mode not Displayed |
| Second | Non-Long Paper | Printing Permitted<br>Icon of Long Paper Mode Not Displayed | | Selection Impossible | | |

According to Table 2, when the post-processing apparatus 100 is in the first position and when the long paper mode is selected, a printing permission message is displayed on the display panel, and an icon of the non-long paper mode is not displayed. Thereby, selection of the non-long paper mode is impossible. When the post-processing apparatus 100 is moved from the first position to the second position, a printing prohibition message is displayed on the display panel as a warning (see FIG. 10). Simultaneously, the icon of the non-long paper mode is displayed, and an icon of the long paper mode is not displayed.

When the post-processing apparatus 100 is in the first position and when the non-long paper mode is selected, a printing prohibition message is displayed on the display panel as a warning (see FIG. 9), and the icon of the non-long paper mode is not displayed. Then, when the print mode is changed to the long paper mode, the warning message is deleted from the display panel, and a printing permission message is displayed. Also, when the post-processing apparatus 100 is moved from the first position to the second position, the warning message is deleted from the display panel, and a printing permission message is displayed.

When the post-processing apparatus 100 is in the second position and when the long paper mode is selected, a printing prohibition message is displayed on the display panel as a warning (see FIG. 10), and the icon of the long paper mode is not displayed. Then, when the print mode is changed to the non-long paper mode, the warning message is deleted from the display panel, and a printing permission message is displayed. Also, when the post-processing apparatus 100 is moved from the second position to the first position, the warning message is deleted from the display panel, and a printing permission message is displayed.

When the post-processing apparatus 100 is in the second position and when the non-long paper mode is selected, a printing permission message is displayed on the display panel, and the icon of the long paper mode is not displayed. Thereby, selection of the long paper mode is impossible. When the post-processing apparatus 100 is moved from the second position to the first position, a printing prohibition message is displayed on the display panel as a warning (see FIG. 9). Simultaneously, the icon of the long paper mode is displayed, and the icon of the non-long paper mode is not displayed.

Control Procedure of Post-Processing Apparatus; See FIGS. 12 and 13

Figure 12:
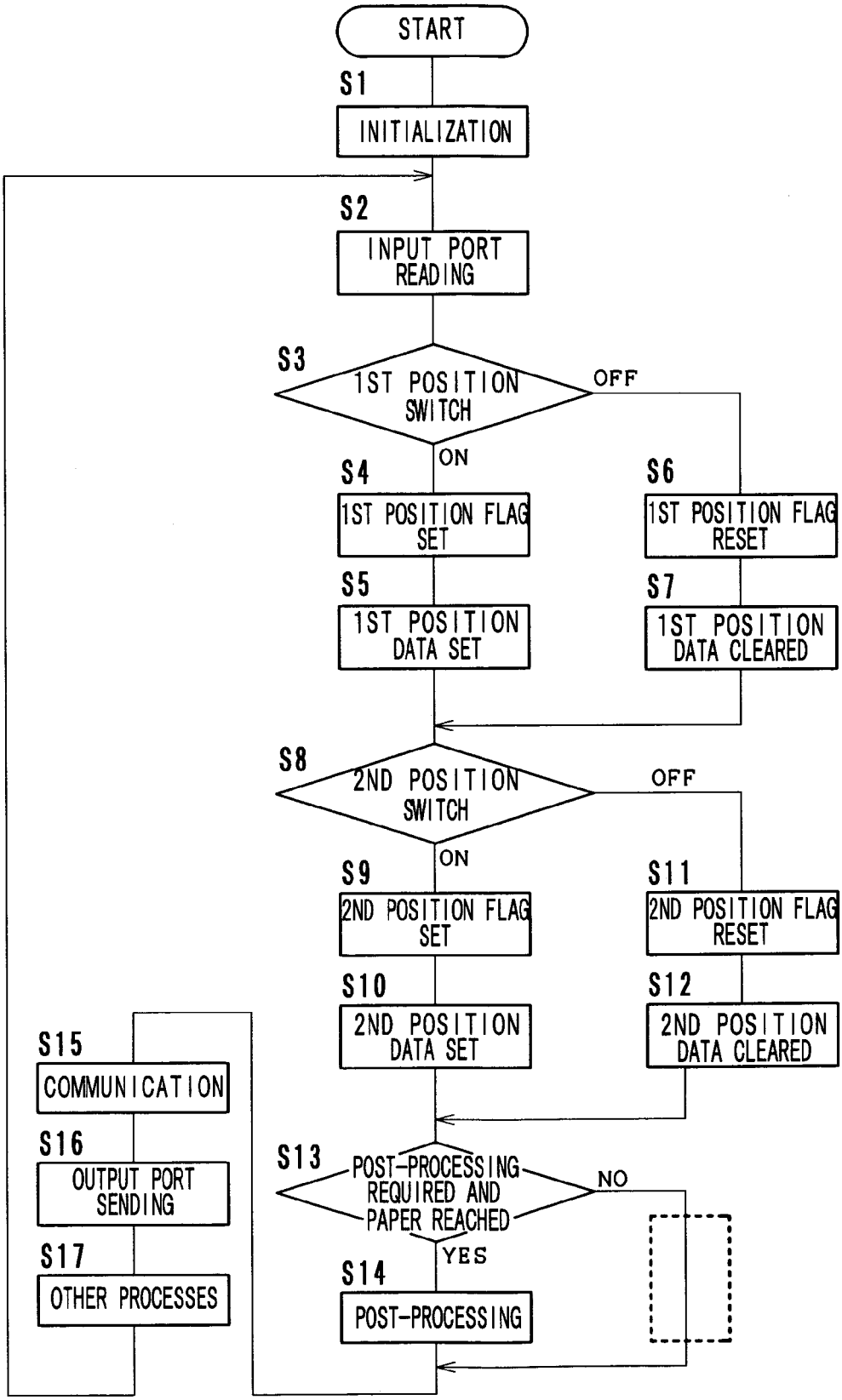
FIGS. 12 and 13 are flowcharts showing a control procedure of the post-processing apparatus.

The CPU 301 follows a control procedure as described below. As FIG. 12 shows, first, the CPU 301 carries out initialization at step S1 and receives signals through the input port at step S2. Next at step S3, the CPU 301 judges the first position switch SW1 whether to be on or off. If the post-processing apparatus 100 is judged to be in the first position (ON of the switch SW1), a first position flag is set at step S4, and first position transmission data are set at step 5. If the post-processing apparatus 100 is not in the first position (OFF of the switch SW1), the first position flag is reset at step S6, and the first position transmission data are cleared at step S7.

Also, the CPU 301 judged the second position switch SW2 whether to be on or off at step S8. If the post-processing apparatus 100 is judged to be in the second position (ON of the switch SW2), a second position flag is set at step S9, and second position transmission data are set at step S10. If the post-processing apparatus 100 is not in the second position (OFF of the switch SW2), the second position flag is reset at step S11, and the second position transmission data are cleared at step S12.

Next, when post-processing is necessary and when a paper reaches the post-processing apparatus 100 (YES at step S13), post-processing is performed at step S14. Thereafter, the CPU 301 performs communication at step S15 and sends necessary signals to the image forming apparatus 1 through the output port at step S16, and other necessary processes are performed at step S17.

On the other hand, when post-processing is not necessary or when no papers reach the post-processing apparatus 100 (NO at step S13), the program goes to step S15.

Figure 13:
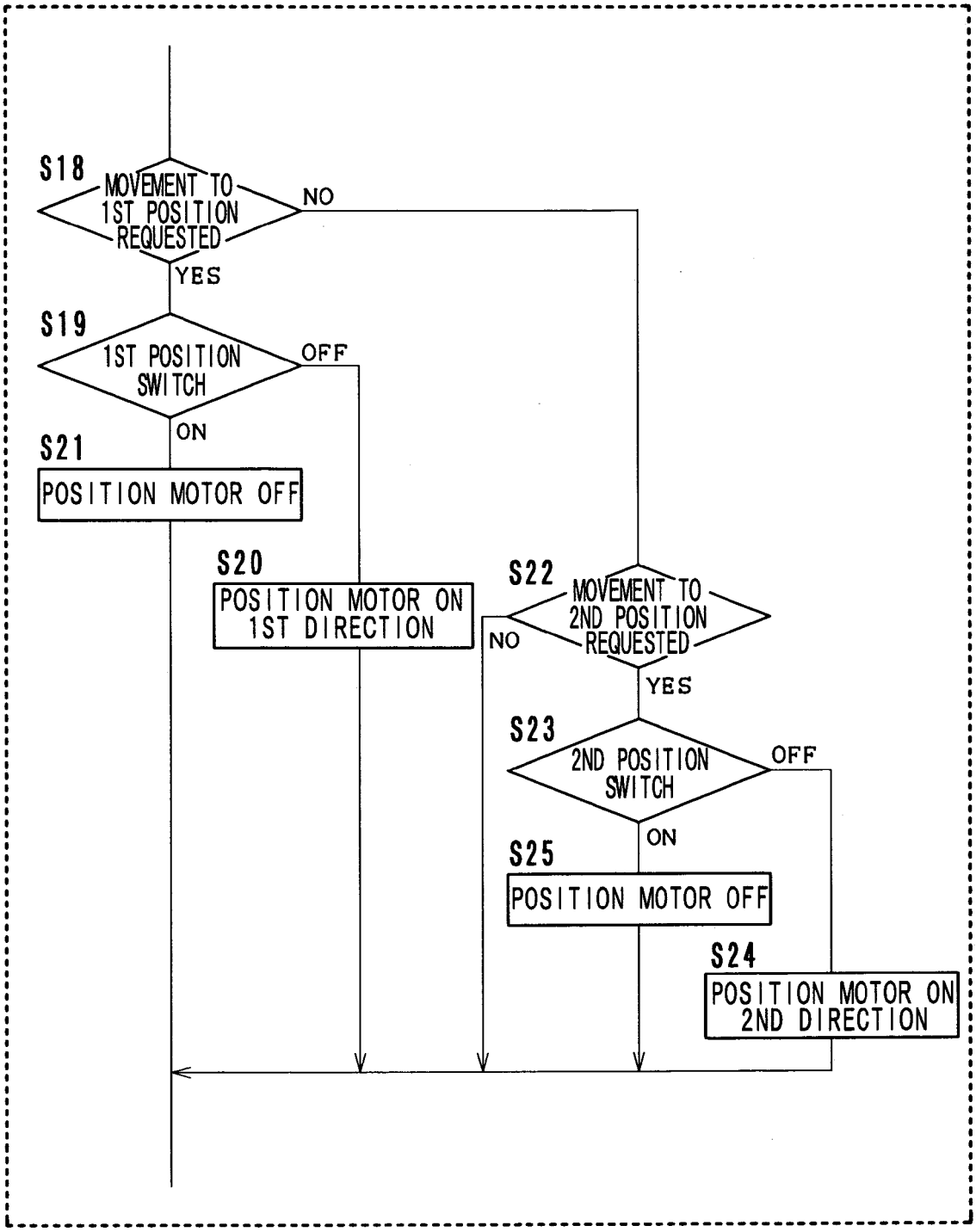

If the post-processing apparatus 100 has an automatic moving mechanism for moving the post-processing apparatus 100 to the first position or to the second position automatically (see the motor 130 in FIG. 6), when NO at step S13, a routine shown by FIG. 13 is carried out.

It is judged at step S18 whether a movement to the first position is requested. If there is a movement request and if the first position switch SW1 is off (OFF at step S19), the motor 130 is turned on to rotate in a first direction at step S20. Then, when the switch SW1 is turned on (ON at step S19), the motor 130 is turned off at step S21.

It is judged at step S22 whether a movement to the second position is requested. If there is a movement request and if the second position switch SW2 is off (OFF at step S23), the motor 130 is turned on to rotate in a second direction at step S24. Then, when the switch SW2 is turned on (ON at step S23), the motor 130 is turned off at step S25.

Control Procedure 1 of Image Forming Apparatus; See FIGS. 14 and 15

Figure 14:
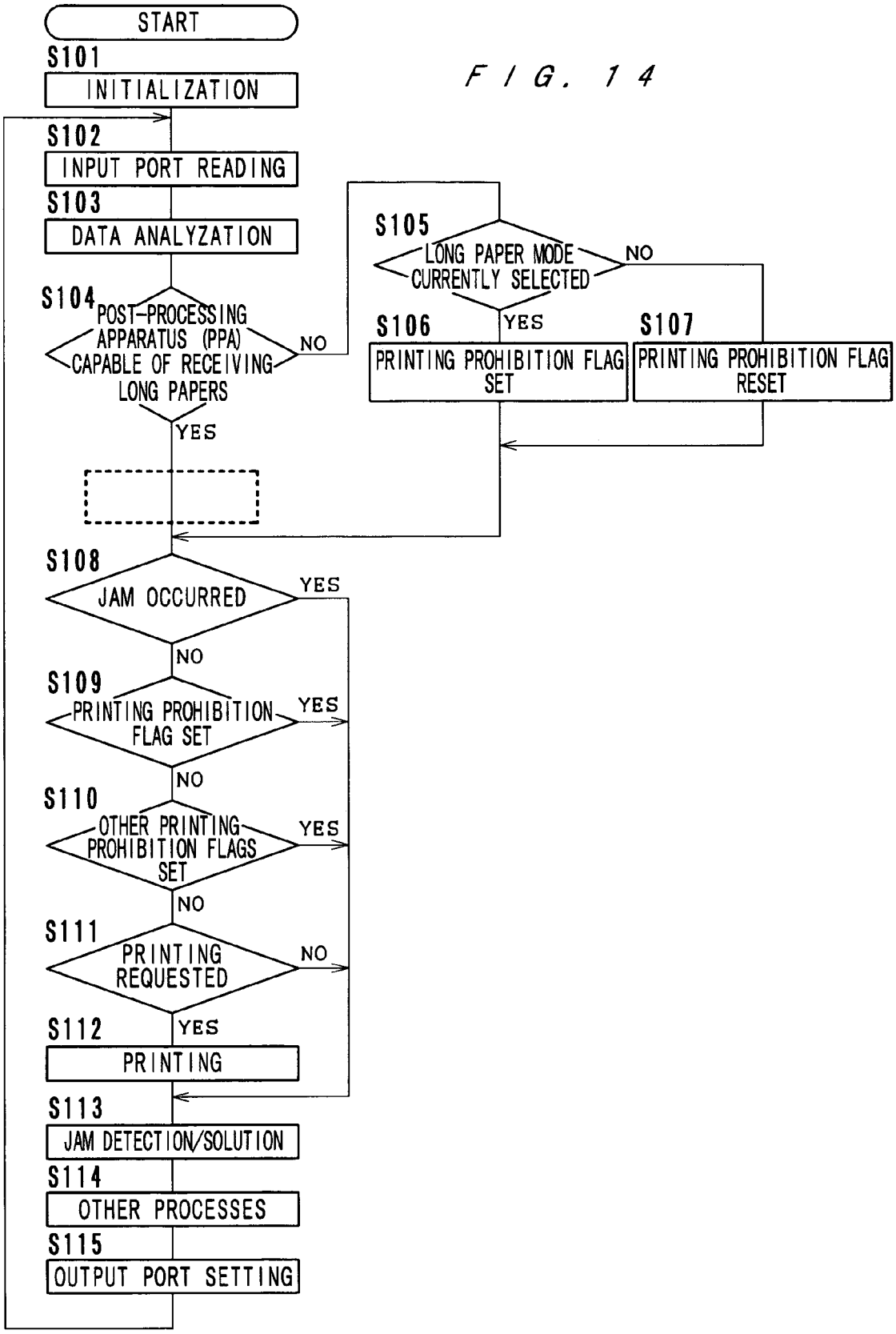
FIGS. 14 and 15 are flowcharts showing a control procedure 1 of the image forming apparatus.

The CPU 201 follows a control procedure as described below. The control procedure 1 is to carry out the control shown by Table 2. As FIG. 14 shows, the CPU 201 first carries out initialization at step S101 and receives signals through the input port at step S102. Next, the CPU 201 analyzes data received from the CPU 301 at step S103 and judges whether the post-processing apparatus 100 is of a type capable of receiving long papers at step S104.

If the post-processing apparatus 100 is not of a type capable of receiving long papers (NO at step S104), the CPU 201 judges whether the long paper mode is currently selected at step S105. If the long paper mode is selected, a printing prohibition flag is set at step S106, and if the long paper mode is not selected, the printing prohibition flag is reset at step S107.

Next, the CPU 201 confirms non-occurrence of a paper jam (NO at step S104), reset of the printing prohibition flag (NO at step S109) and reset of other printing prohibition flags (NO at step S110). Thereafter, when printing is requested (YES at step S111), printing is carried out at step S112. During printing, the CPU 201 carries out detection/solution of a paper jam at step S113, which will be described later, and other processes (step S114), such as temperature regulation of the fixing unit 25, etc. Then, the CPU 201 sends signals through the output port at step S115, and the program returns to the step S102.

Figure 15:
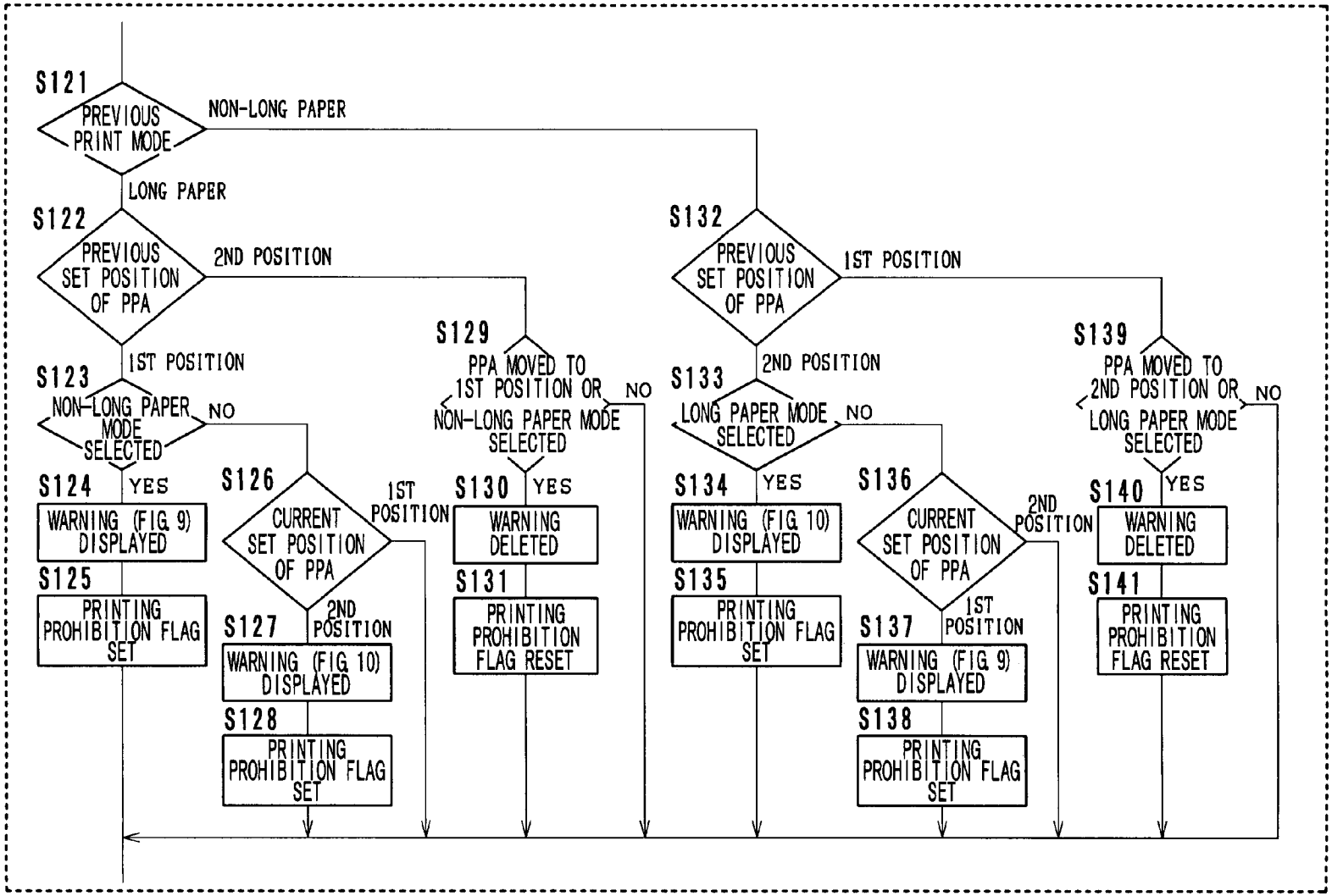

If the post-processing apparatus 100 is of a type capable of receiving long papers (YES at step 104), as shown by FIG. 15, the CPU 201 judges the previous print mode at step S121 and the previous set position of the post-processing apparatus 100 at step S122 or S132. If the previous print mode is the long paper mode and if the previous set position of the post-processing apparatus 100 is the first position (judged at step S122), when the non-long paper mode is currently selected (YES at step S123), a printing prohibition message (see FIG. 9) is displayed on the display at step S124, and the printing prohibition flag is set at step S125.

If the long paper mode is kept selected (NO at step S123), when the post-processing apparatus 100 is set in the second position (judged at step S126), a printing prohibition message (see FIG. 10) is displayed on the display panel at step S127, and the printing prohibition flag is set at step S128.

If the previous set position of the post-processing apparatus 100 is judged to be the second position at step S122, when the post-processing apparatus 100 is set in the first position or when the non-long paper mode is selected (YES at step S129), the printing prohibition message is deleted from the display panel at step S130, and the printing prohibition flag is reset at step S131.

If the previous print mode is judged to be the non-long paper mode at step S121 and if the previous position of the post-processing apparatus 100 is the second position (judged at step S132), when the long paper mode is selected (YES at step S133), the printing prohibition message (see FIG. 10) is displayed on the display panel at step S134, and the printing prohibition flag is set at step S135.

If the non-long paper mode is kept selected (NO at step S133), when the post-processing apparatus 100 is set in the first position (judged at step 136), the printing prohibition message (see FIG. 9) is displayed on the display panel at step S137, and the printing prohibition flag is set at step S138.

If the previous position of the post-processing apparatus 100 is judged to be the first position at step S132, when the post-processing apparatus 100 is set in the second position or when the long paper mode is selected (YES at step S139), the printing prohibition message is deleted from the display panel at step S140, and the printing prohibition flag is reset at step S141.

Control Procedure 2 of the Image forming Apparatus; See FIG. 16

Figure 16:
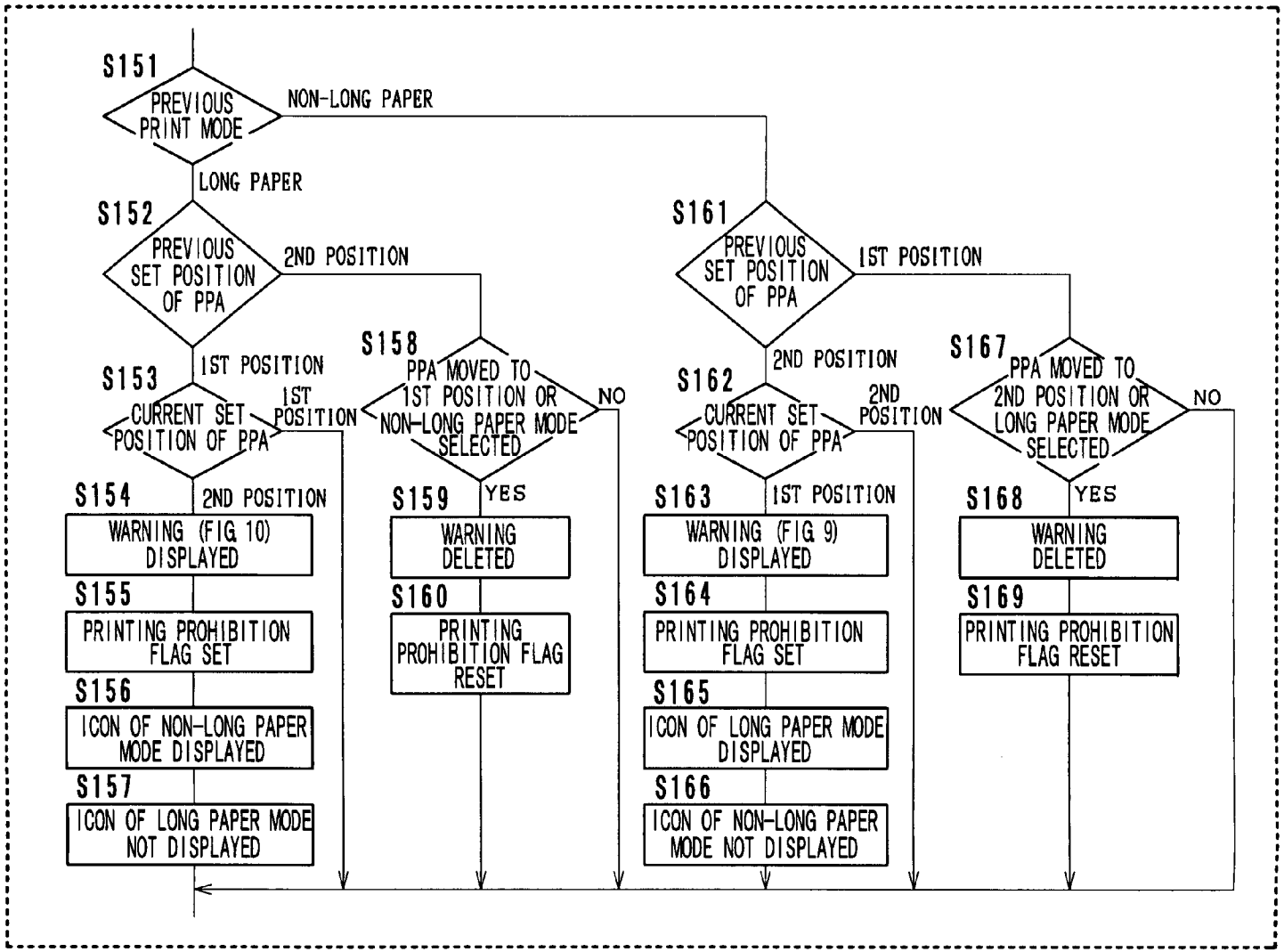
FIG. 16 is a flowchart showing a control procedure 2 of the image forming apparatus.

The CPU 201 alternatively may follow a control procedure 2 as shown by FIG. 16. The control procedure 2 is to carry out the control shown by Table 2, and the processes at steps S121 through S141 shown by FIG. 15 are replaced with processes at steps S151 through S169 shown by FIG. 16.

If the post-processing apparatus 100 is of a type capable of receiving long papers (YES at step S104 shown in FIG. 14), as FIG. 16 shows, the previous print mode is judged at step S151, and the previous set position of the post-processing apparatus 100 is judged at step S152 or S161. If the previous print mode is judged to be the long paper mode and if the previous set position of the post-processing apparatus 100 is judged to be the first position (judged at step S152), when the post-processing apparatus 100 is moved to the second position (judged at step S153), the printing prohibition message (see FIG. 10) is displayed on the display at step S154, and the printing prohibition flag is set at step S155. Further, the icon of the non-long paper mode is displayed at step S156, and the icon of the long paper mode is not displayed at step S157.

If the previous set position of the post-processing apparatus 100 is judged to be the second position at step S152, when the post-processing apparatus 100 is moved to the first position or when the non-long paper mode is selected (YES at step S158), the printing prohibition message is deleted from the display panel at step S159, and the printing prohibition flag is reset at step S160.

If the previous print mode is judged to be the non-long paper at step S151 and if the set position of the post-processing apparatus 100 is judged to be the second position at step S161, when the post-processing apparatus 100 is set in the first position (judged at step S162), the printing prohibition message (see FIG. 9) is displayed on the display at step S163, and the printing prohibition flag is set at step S164. Further, the icon of the long paper mode is displayed on the display panel at step S165, and the icon of the non-long paper mode is not displayed at step S166.

If the previous position of the post-processing apparatus 100 is judged to be the first position at step S161, when the post-processing apparatus 100 is set in the second position or when the long paper mode is selected (YES at step S167), the printing prohibition message is deleted from the display panel at step S168, and the printing inhibition flag is reset at step S169.

Control Procedure 3 of the Image Forming Apparatus; See FIG. 17

Figure 17:
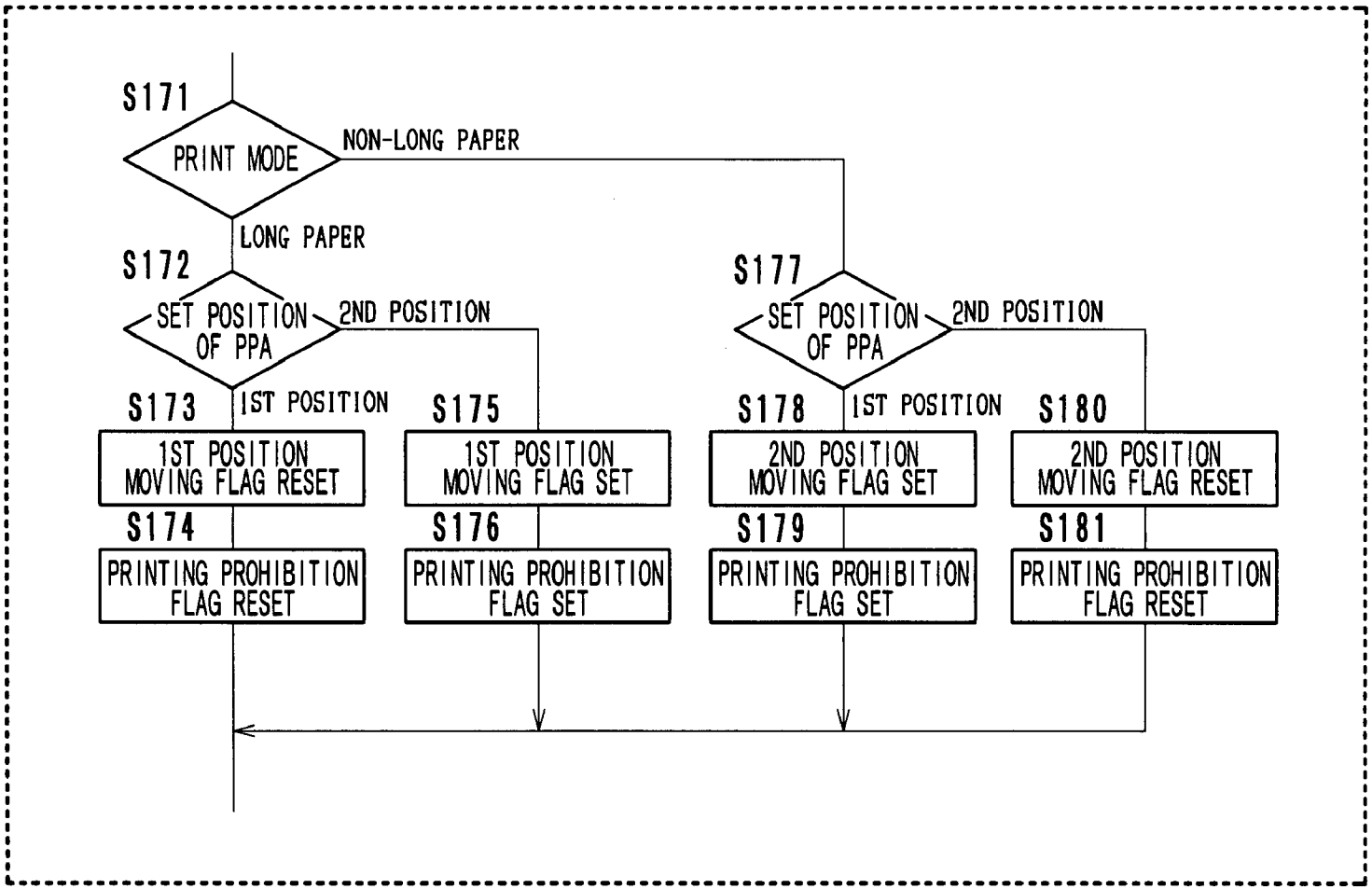
FIG. 17 is a flowchart showing a control procedure 3 of the image forming apparatus.

The CPU 201 may follow a control procedure 3 as shown by FIG. 17. The control procedure 3 is for a case wherein the post-processing apparatus 100 has the motor 130 (see FIG. 6) and is to send a request of movement of the post-processing apparatus 100 from the image forming apparatus 1. According to the control procedure 3, the processes at steps S121 through S141 shown by FIG. 15 are replaced with processes at steps S171 through S181 shown by FIG. 17.

If the post-processing apparatus 100 is of a type capable of receiving long papers (YES at step S104 shown in FIG. 14), as FIG. 17 shows, the selected print mode is judged at step S171, and the position of the post-processing apparatus 100 is judged at step S172 or S177. If the long paper mode is selected and if the post-processing apparatus 100 is set in the first position (judged at step S172), a first position moving flag for requesting movement of the post-processing apparatus 100 to the first position is reset at step S173, and the printing prohibition flag is reset at step S174. If the post-processing apparatus 100 is judged to be in the second position at step S172, the first position moving flag is set at step S175, and the printing prohibition flag is set at step S176.

If the non-long paper mode is selected and if the post-processing apparatus 100 is set in the first position (judged at step S177), a second position moving flag for requesting movement of the post-processing apparatus 100 to the second position is set at step S178, and the printing prohibition flag is set at step S179. If the post-processing apparatus 100 is judged to be in the second position at step S177, the second position moving flag is reset at step S180, and the printing prohibition flag is reset at step S181.

Control Procedure 4 of the Image Forming Apparatus; See FIG. 18

Figure 11:
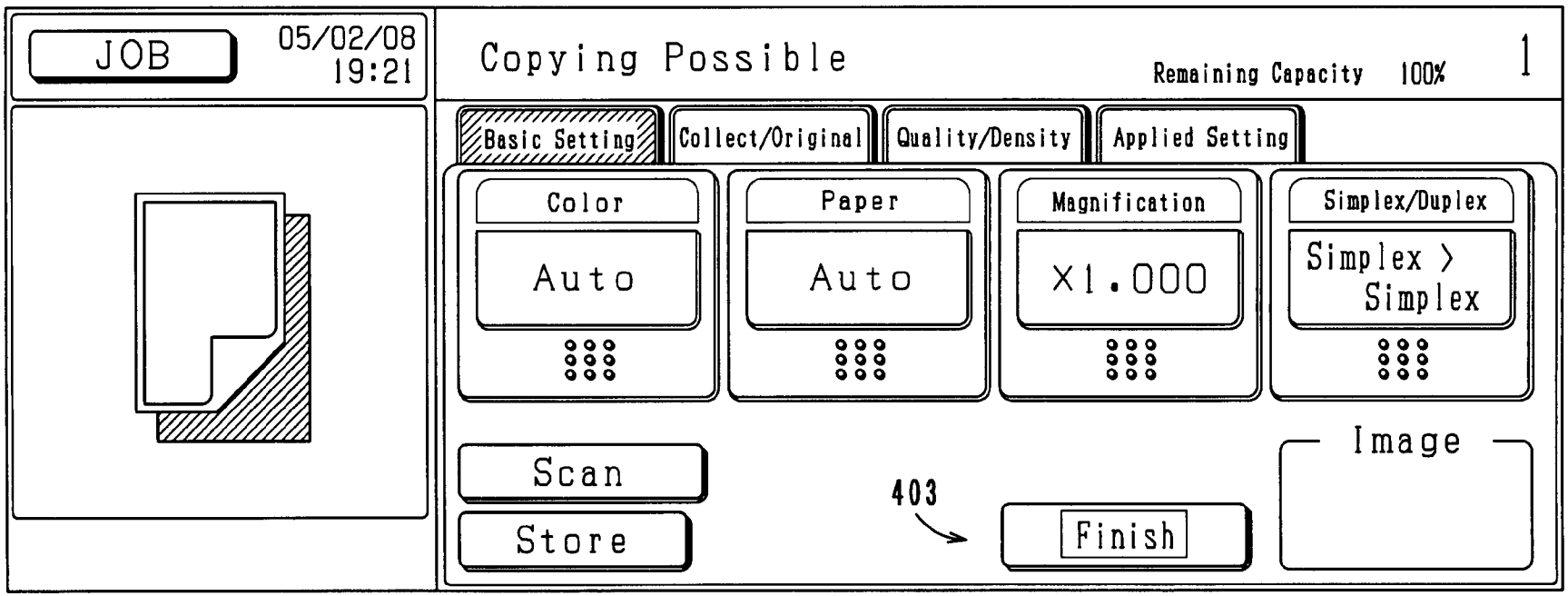
FIG. 11 is a plan view of the display panel, showing an initial display.
Figure 18:
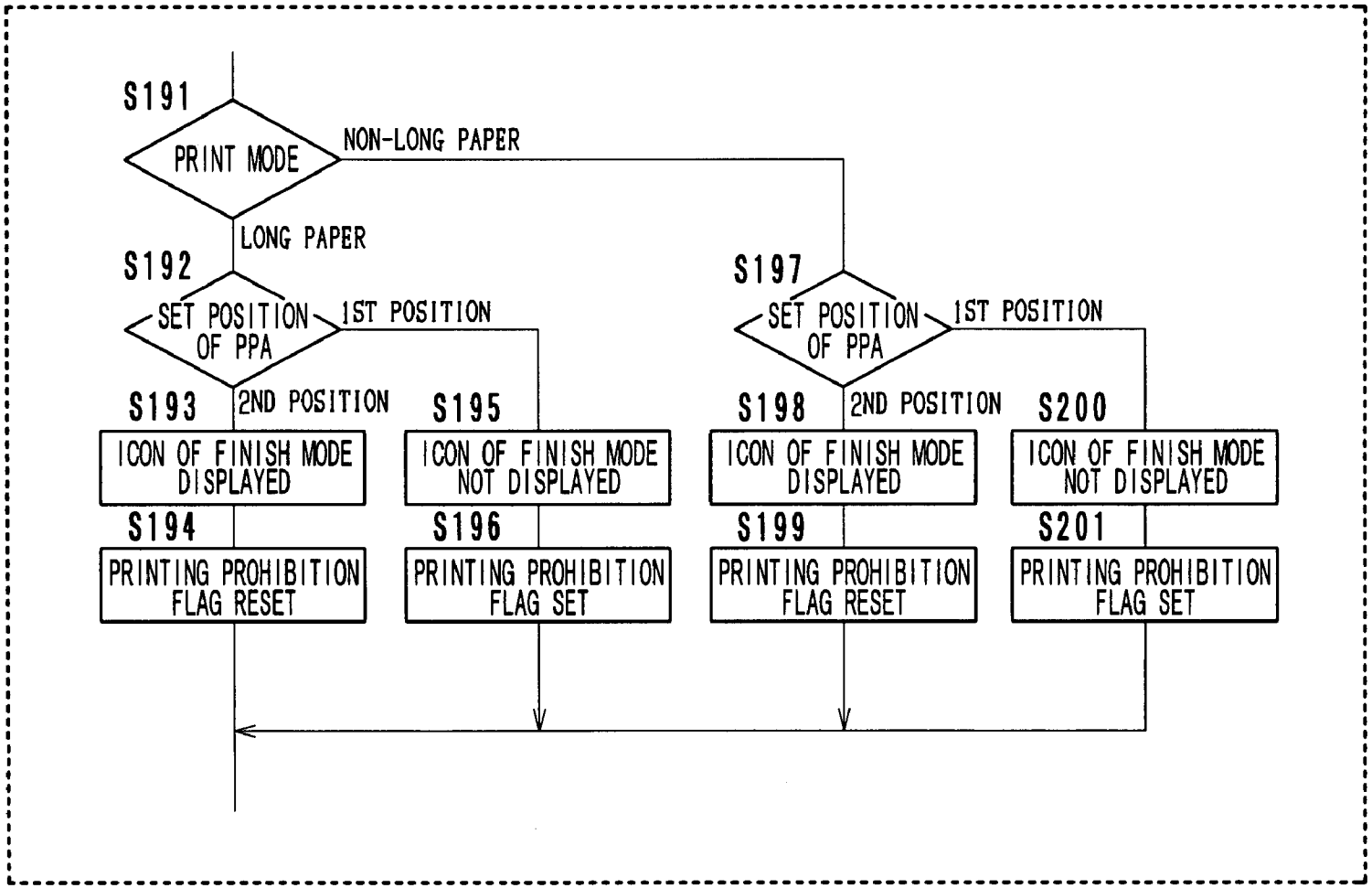
FIG. 18 is a flowchart showing a control procedure 4 of the image forming apparatus.

The CPU 201 may follow a control procedure 4 as shown by FIG. 18. The control procedure 4 is to prohibit movement of the post-processing apparatus 100 when the post-processing apparatus 100 is set in the first position. According to the control procedure 4, the processes at steps S121 through S141 shown by FIG. 15 are replaced with processes at steps S191 through S201 shown by FIG. 18. An "icon of a finish mode" in the following description of the routine is that denoted by numeral 403 in FIG. 11, which shows the initial state of the display panel.

If the post-processing apparatus 100 is of a type capable of receiving long papers (YES at step S104 in FIG. 14), as FIG. 18 shows, the selected print mode is judged at step S191, and the position of the post-processing apparatus 100 is judged at step S192 or S197. If the long paper mode is selected and if the post-processing apparatus 100 is set in the second position (judged at step S192), the icon of the finish mode is displayed on the display panel at step S193, and the printing prohibition flag is reset at step S194. If the post-processing apparatus 100 is judged to be in the first position at step S192, the icon of the finish mode is not displayed at step S195, and the printing prohibition flag is set at step S196.

If the non-long paper mode is selected and if the post-processing apparatus 100 is set in the second position (judged at step S197), the icon of the finish mode is displayed on the display panel at step S198, and the printing prohibition flag is reset at step S199. If the post-processing apparatus 100 is judged to be in the first position at step S197, the icon of the finish mode is not displayed at step S200, and the printing prohibition flag is set at step S201.

Control Procedure 5 of the Image Forming Apparatus; See FIG. 19

Figure 19:
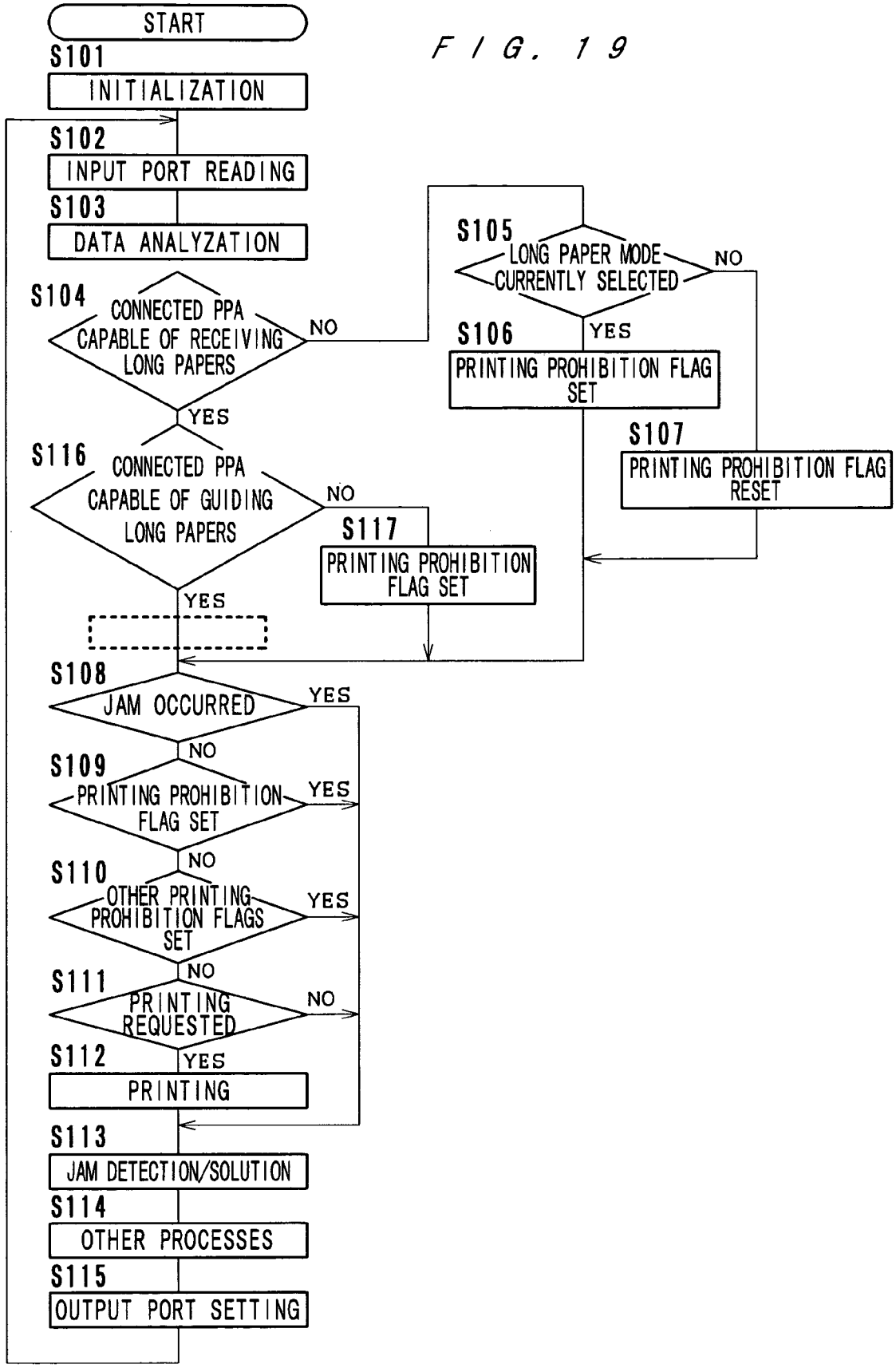
FIG. 19 is a flowchart showing a control procedure 5 of the image forming apparatus.

FIG. 19 shows a control procedure 5 which may be carried out by the CPU 201. The control procedure 5 is for a case wherein the image forming apparatus 1 is connectable selectively to different kinds of post-processing apparatuses. The control procedure 5 is basically same as the control procedure 1 shown by FIG. 14, and in the area enclosed by the dashed lines in FIG. 19, one of the routines shown by FIGS. 15 through 18 is inserted.

In FIG. 19, at the steps denoted by the same reference numbers as those in FIG. 14, the same processes are carried out, and repetitious descriptions are omitted. What is different from the control procedure 1 shown by FIG. 14 is that when the post-processing apparatus 100 is judged to be of a type capable of receiving long papers (YES at step S104), it is judged whether the post-processing apparatus 100 is capable of guiding long papers. If the post-processing apparatus 100 is capable of guiding long papers (YES at step S116), the routine shown by either one of FIGS. 15 through 18 is carried out. If the post-processing apparatus 100 cannot guide long papers (NO at step S116), the printing prohibition flag is set at step S117.

Figure 20:
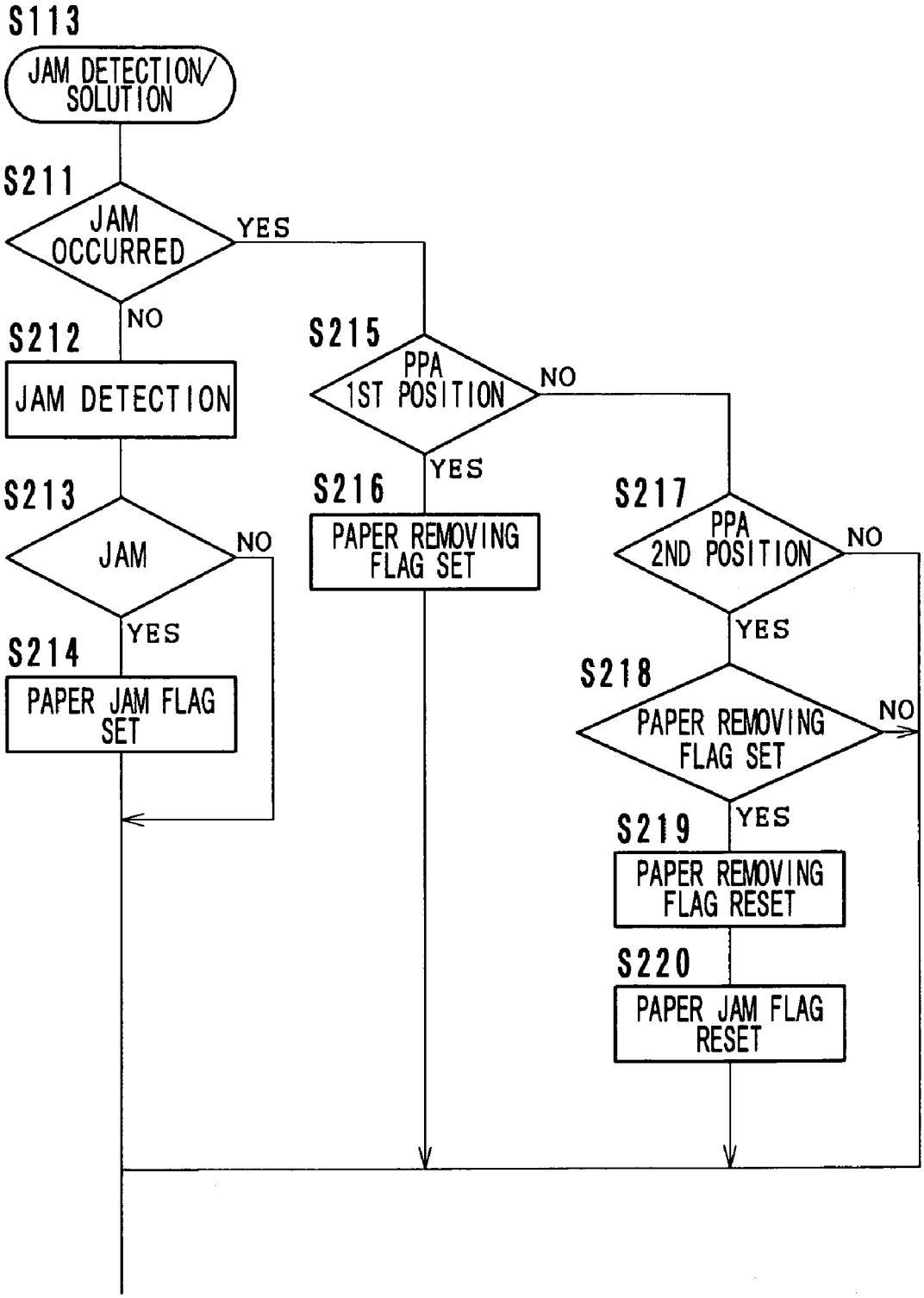
FIG. 20 is a flowchart showing a control procedure for detection/solution of a paper jam.

Control Procedure in a Case of Paper Jam; See FIG. 20

Now, the paper jam detection/solution process at step S113 is described.

First, it is judged at step S211 whether it is in the middle of a paper jam. If it is not in the middle of a paper jam, a paper jam detection process is carried out at step S212. When a paper jam is detected (YES at step S213), a paper jam flag is set at step S214.

If it is in the middle of a paper jam (YES at step S211), the position of the post-processing apparatus 100 is judged at step S215 or at step S217. If the post-processing apparatus 100 is set in the first position, a paper removing flag is set at step S216.

If the post-processing apparatus 100 is set in the second position (YES at step S217) and if the paper removing flag is set (YES at step S218), the paper removing flag is reset at step S219. Then, the paper jam flag is reset at step S210.

In other words, moving the post-processing apparatus 100 to the first position after detection of a paper jam (YES at step S215) means that a jammed paper is being removed with the post-processing apparatus 100 apart from the image forming apparatus 1. Therefore, the CPU 201 sets the paper removing flag at step S216. Moving the post-processing apparatus 100 to the second position thereafter (YES at step S217) means that the post-processing apparatus 100 is returned closer to the image forming apparatus 1 after removal of the jammed paper. Therefore, the CPU 201 resets the paper removing flag and the paper jam flag at steps S219 and S220.

OTHER EMBODIMENTS

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming system comprising:
an image forming apparatus;
a post-processing apparatus; and
a control section for controlling the image forming apparatus and the post-processing apparatus;
wherein the post-processing apparatus is movable between a first position to receive a long paper from the image forming apparatus and a second position to receive a non-long paper from the image forming apparatus;
wherein when the post-processing apparatus is moved to the first position after detection of a paper jam in the image forming apparatus, the control section judges that a jammed paper is being removed, and when the post-processing apparatus is moved to the second position thereafter, the control section judges that the removal of the jammed paper has been completed.

2. An image forming system comprising:
an image forming apparatus;
a post-processing apparatus; and
a control section for controlling the image forming apparatus and the post-processing apparatus;
wherein the post-processing apparatus is movable between a first position to receive a long paper from the image forming apparatus and a second position to receive a non-long paper from the image forming apparatus;
wherein when the post-processing apparatus is set in the first position, an upper surface of a cover of the post processing apparatus serves as a guide of a long paper being ejected from the image forming apparatus.

3. The image forming system according to claim 2,
wherein the first position of the post-processing apparatus is a position away from the image forming apparatus, and the second position of the post processing apparatus is a position near the image forming apparatus relative to the first position.

4. The image forming system according to claim 2, further comprising at least one of the following:
a first detector for detecting whether the post-processing apparatus is in the first position; and
a second detector for detecting whether the post-processing apparatus is in the second position.

5. The image forming system according to claim 2, wherein the post-processing apparatus is movable manually between the first position and the second position.

6. The image forming system according to claim 2, wherein the post-processing apparatus is movable automatically between the first position and the second position.

7. The image forming system according to claim 2, wherein the control section has different criteria for judgment depending on whether the post-processing apparatus is set in the first position or in the second position or whether a print mode of the image forming apparatus is a long paper mode in which a long paper is used or a non-long paper mode in which a non-long paper is used.

8. The image forming system according to claim 7, wherein in the long paper mode, the control section judges that printing is not desired at least unless the post-processing apparatus is in the first position.

9. The image forming system according to claim 7, wherein when the control section judges that printing is not desired, the control section prohibits the image forming apparatus from printing.

10. The image forming system according to claim 7, wherein in the non-long paper mode, the control section judges that printing is not desired at least unless the post-processing apparatus is in the second position.

11. The image forming system according to claim 10, wherein when the control section judges that printing is not desired, the control section prohibits the image forming apparatus from printing.

12. An image forming system comprising:
an image forming apparatus;
a post-processing apparatus; and
a control section for controlling the image forming apparatus and the post-processing apparatus;
wherein the post-processing apparatus is movable between a first position to receive a long paper from the image forming apparatus and a second position to receive a non-long paper from the image forming apparatus;
when the post-processing apparatus is in the first position, the upper surface of a cover of the post-processing apparatus is located below a paper ejection port of the image forming apparatus; and
when the post-processing apparatus is in the second position, a paper inlet port of the post-processing apparatus substantially faces the paper ejection port of the image forming apparatus.

13. The image forming system according to claim 8, wherein when the control section judges that printing is not desired, the control section raises a warning to change the position of the post-processing apparatus.

14. The image forming system according to claim 10, wherein when the control section judges that printing is not desired, the control section raises a warning to change the position of the post-processing apparatus.

15. The image forming system according to claim 8, wherein when the control section judges that printing is not desired, the control section raises a warning to change the print mode.

16. The image forming system according to claim 10, wherein when the control section judges that printing is not desired, the control section raises a warning to change the print mode.

17. The image forming system according to claim 6, wherein in the long paper mode, when the post-processing apparatus is not in the first position, the control section controls to move the post-processing apparatus to the first position.

18. The image forming system according to claim 6, wherein in the non-long paper mode, when the post-processing apparatus is not in the second position, the control section controls to move the post-processing apparatus to the second position.

19. The image forming system according to claim 2, wherein when the post-processing apparatus is not in the first position, the control section prohibits selection of a long paper mode in which a long paper is used.

20. The image forming system according to claim 2, wherein when the post-processing apparatus is not in the second position, the control section prohibits selection of a non-long paper mode in which a non-long paper is used.

21. The image forming system according to claim 2, wherein:
the image forming apparatus is connectable selectively to different types of post-processing apparatuses; and
the control section judges the type of the post-processing apparatus connected to the image forming apparatus and changes a control procedure in a long paper mode in which a long paper is used in accordance with the type of the post-processing apparatus.

22. The image forming system according to claim 2, wherein when the post-processing apparatus is set in the first position, the control section prohibits movement of the post-processing apparatus.

* * * * *